US006075193A

United States Patent [19]

Aoki et al.

[11] Patent Number: 6,075,193

[45] Date of Patent: Jun. 13, 2000

[54] AUTOMATIC MUSIC COMPOSING APPARATUS AND COMPUTER READABLE MEDIUM CONTAINING PROGRAM THEREFOR

[75] Inventors: Eiichiro Aoki; Toshio Sugiura, both of Hamamatsu, Japan

[73] Assignee: Yamaha Corporation, Hamamatsu, Japan

[21] Appl. No.: 09/170,495

[22] Filed: Oct. 13, 1998

[30] Foreign Application Priority Data

Oct. 14, 1997 [JP] Japan ..... 9-280848

[51] Int. Cl.[7] ..... G10H 7/00

[52] U.S. Cl. ..... 84/609; 84/610; 84/634; 84/649; 84/650

[58] Field of Search ..... 84/609–614, 634–638, 84/622–625, 649–652

[56] References Cited

U.S. PATENT DOCUMENTS

| | | | |
|---|---|---|---|
| 5,375,501 | 12/1994 | Okuda | 84/611 |
| 5,705,761 | 1/1998 | Minamitaka | 84/609 |
| 5,736,663 | 4/1998 | Aoki et al. | 84/609 |

*Primary Examiner*—Robert E. Nappi
*Assistant Examiner*—Marlon Fletcher
*Attorney, Agent, or Firm*—Graham & James LLP

[57] ABSTRACT

An automatic music composing apparatus comprises a musical template data base storing a plurality of musical templates each including a first set of data constituting a musical melody sample defined by a pattern of musical tone pitch progression in a pattern of rhythm to be performed for a musical piece and a second set of data indicative of musical features of said musical melody sample. The melody sample is constructed and partitioned in such a hierarchical structure that a musical piece is comprised of sentences, each sentence is comprised of phrases, each phrase is comprised of measures, and each measure includes a plurality of notes having respective pitches and durations to constitute a melody segment having a rhythm pattern. The apparatus comprises an input device for inputting composition conditions to define musical features for a musical piece to be composed in terms of the number of sentences, phrases and measures, and similarity symbols of each sentence. Comparing the structure and the features of each template with the requested composition conditions, the apparatus retrieves candidate templates from the database according to the substitution rules unique to the invention.

17 Claims, 15 Drawing Sheets

Fig.7

| PHRASE IN INPUTTED CONDITIONS | | PHRASE IN MUSICAL TEMPLATE TO BE USED | | |
|---|---|---|---|---|
| | | NUMBER OF PHRASES = 1 | NUMBER OF PHRASES = 2 | NUMBER OF PHRASES = 3 |
| WHERE NUMBER OF PHRASES = 1 | FIRST PHRASE | @1 | @1 | @1 |
| WHERE NUMBER OF PHRASES = 2 | FIRST PHRASE | @1 | @1 | @1 |
| | SECOND PHRASE | @1 | @2 | @3 |
| WHERE NUMBER OF PHRASES = 3 | FIRST PHRASE | @1 | @1 | @1 |
| | SECOND PHRASE | @1 | @2 | @2 |
| | THIRD PHRASE | @1 | @2 | @3 |

Fig. 11

| MEASURE IN INPUTTED CONDITIONS | | MEASURE IN MUSICAL TEMPLATE TO BE USED | | |
|---|---|---|---|---|
| | | NUMBER OF MEASURES =1 | NUMBER OF MEASURES = 2 | NUMBER OF MEASURES =3 |
| WHERE NUMBER OF MEASURES = 1 | FIRST MEASURE | @1 | @1 | @1 |
| WHERE NUMBER OF MEASURES = 2 | FIRST MEASURE | | @1 | @1 |
| | SECOND MEASURE | | @2 | @3 |
| WHERE NUMBER OF MEASURES = 3 | FIRST MEASURE | | | @1 |
| | SECOND MEASURE | | | @2 |
| | THIRD MEASURE | | | @3 |

Fig. 15

| | ADDRESS | DATA | MEANING OF DATA |
|---|---|---|---|
| DATA BLOCK FOR ONE MUSICAL PIECE | 0 | 56 | MUSICAL TEMPLATE NUMBER |
| | 1 | A | SENTENCE SYMBOL IN TEMPLATE TO BE APPLIED TO THE FIRST SENTENCE |
| | 2 | 1 | PHRASE NUMBER IN TEMPLATE TO BE APPLIED TO THE FIRST PHRASE |
| | 3 | 1 | MEASURE NUMBER IN TEMPLATE TO BE APPLIED TO THE FIRST MEASURE |
| | 4 | 2 | MEASURE NUMBER IN TEMPLATE TO BE APPLIED TO THE SECOND MEASURE |
| | 5 | - | MEASURE NUMBER IN TEMPLATE TO BE APPLIED TO THE THIRD MEASURE |
| | 6 | 2 | PHRASE NUMBER IN TEMPLATE TO BE APPLIED TO THE SECOND PHRASE |
| | 7 | 1 | MEASURE NUMBER IN TEMPLATE TO BE APPLIED TO THE FIRST MEASURE |
| | 8 | 2 | MEASURE NUMBER IN TEMPLATE TO BE APPLIED TO THE SECOND MEASURE |
| | 9 | - | MEASURE NUMBER IN TEMPLATE TO BE APPLIED TO THE THIRD MEASURE |
| | 10 | | |
| | : | B | SENTENCE SYMBOL IN TEMPLATE TO BE APPLIED TO THE SECOND SENTENCE |
| | | | : |
| | | A' | SENTENCE SYMBOL IN TEMPLATE TO BE APPLIED TO THE THIRD SENTENCE |
| | | | : |
| | | B' | SENTENCE SYMBOL IN TEMPLATE TO BE APPLIED TO THE FOURTH SENTENCE |
| | | | : |
| | | / | DATA-END MARK OF ONE MUSICAL PIECE |
| | | 89 | TEMPLATE NUMBER |
| | | : | : |
| | | END | ALL-DATA-END MARK |

AUTOMATIC MUSIC COMPOSING APPARATUS AND COMPUTER READABLE MEDIUM CONTAINING PROGRAM THEREFOR

BACKGROUND OF THE INVENTION

1. Field of the Invention

The present invention relates to an automatic music composing apparatus capable of composing a musical piece by using musical templates which are selected based on given conditions for musical composition, and also relates to a computer readable medium containing programs to be executed by a computer system to configure the computer system to provide such an automatic music composing apparatus as mentioned above.

2. Description of the Prior Art

Various types of automatic music composing apparatuses have been heretofore proposed and placed in actual use for alleviating the burdens on music composers. As an exemplary type of such automatic music composing apparatuses, the same inventors proposed an automatic melody generating apparatus which are capable of generating melodies based on musical templates as disclosed in the specification and the drawings of Japanese Patent Application No. 8-132208, the disclosure of which is incorporated herein by reference. Although the invention disclosed in the above-mentioned Japanese Patent Application No. 8-132208 (the Prior Application) was proposed prior to the present invention, the Prior Application has been deemed withdrawn, after another Japanese patent application (the Later Application) was filed claiming a priority based on the Prior Application, the Later Application being given an application No. 9-137153 and being published (unexamined) on Feb. 20, 1998 under a publication No. 10-49154 not constituting a published prior art to the present invention. But the description of the Later Application is also incorporated herein by reference. With that automatic melody generating apparatus, the user inputs composition conditions, then the apparatus searches a plurality of pre-stored musical templates for a candidate template or templates which meet(s) the inputted composition conditions to extract the found candidate or candidates for the user's further working. The user will then select one of the candidate templates, and may adopt the selected one as it is or may modify the same as desired, and then will work on the template to create a desired melody piece from the apparatus.

A musical template, as used herein and in the above-mentioned Japanese Patent Application, means a set of data defining a piece of music or skeleton therefor in the form of a succession of segments (i.e. a piece of music is partitioned into segments), each segment carrying musical parameters to determine musical properties of the segment such as a melody segment, a chord progression segment, the sentence similarity symbol of the segment, a feature or character of the segment and the structure of a musical piece. The segments are structured in a hierarchical architecture such that the highest level is an overall structure of a whole musical piece, the second level is musical sentences, the third level is musical phrases, the fourth level is musical measures, and so forth. Namely, a musical piece is comprised of sentences, each sentence is comprised of phrases, and each phrase is comprised of measures. The simplest template may include the structure (sentence, phrase, measure) of a musical piece, a melody skeleton (a basic idea of a melody sample) and similarity symbols for sentences.

The whole melody is partitioned into sentences, each sentence is further partitioned into phrases, each phrase into measures, and each measure includes a note or notes having respective pitches and durations aligned in a progression having a rhythm pattern to constitute a melody segment.

In the automatic melody generating apparatus mentioned above, the composition conditions set by the user include, for an overall musical piece, the meter, the genre (e.g. eight-beat), the mode (major/minor), the melody flow (melodic/rhythmic, i.e. fluent/pulsating), the tempo, the pitch range, the minimum note length, the number of sentences, etc.; and for an individual musical sentence, the number of phrases, the similarity symbol for each sentence, the head and tail chords in the sentence, etc.; and for an individual phrase, the number of measures, etc.; and for an individual measure, the number of syllables (beatings, pulsations), etc. For a musical piece without words, the number of the syllables may not be defined in the conditions.

In the case of the conventional automatic music composing apparatus using musical templates, however, if there is no hit in the search for a template having the identical conditions to the inputted composition conditions, the search should be repeated with some of the conditions omitted to conduct a less strict search. Further, for example, in case the inputted conditions include the sequence of phrase symbols of A-B-A'-B', a template having the phrase symbol sequence of A-B-A-B' cannot be a candidate, which means the number of the candidates selected through the search will inevitably be small. In this context, the mark <'> included in the symbol denotes the similarity (being not identical but similar to a certain degree in terms of melody or other musical properties). Namely, the sentence symbol <A'> is given to a sentence which is melodically (or from some other properties) similar to the sentence to which is given the sentence symbol <A>.

Anyway, where there are only a few candidates obtained as a result of the search, a musical piece that can be generated lacks variety, whichever candidate should be selected. This would lead to narrow freedom in composing musical pieces. The user, of course, composes a musical piece without using templates, but if so, the user cannot enjoy the advantage (efficiency in composition) of using an automatic music composing apparatus.

SUMMARY OF THE INVENTION

It is, therefore, a primary object of the present invention to provide an automatic music composing apparatus and a computer readable medium containing program instructions for configuring a computer system to provide such an apparatus, which can extract a number of musical templates to an extent sufficient for keeping the wide freedom in composing musical pieces without further retrieval operation.

According to the present invention, the object is accomplished by providing an automatic music composing apparatus or a computer readable medium containing program instructions executable by a computer system to configure such an apparatus, which extracts not only the templates containing musical segments having musical properties and features which are identical to the inputted composition conditions, but also the templates containing musical segments having musical properties and features which are similar to the inputted composition conditions, thereby increasing the number of candidate templates to be extracted for use in composing a musical piece.

According to an aspect of the present invention, an automatic music composing apparatus comprises: a template data base storing a plurality of musical templates each including a set of data defining a musical piece, the musical piece being subdivided into a plurality of musical segments, the set of data including subsets of data respectively defining musical properties of the musical segments; input means for inputting composition conditions including requirements on musical properties for a musical piece to be composed; retrieval means for searching the template data base to extract a candidate musical template which includes the subset of data indicative of the musical properties which are identical with or similar to the musical properties required by the inputted composition conditions; and composition means for composing a musical piece based on the extracted candidate musical template.

In a preferable specific construction of the above aspect: the musical segments constitute musical sentences; the subsets of data include data which define sentence symbols indicative of degrees of similarity among the musical sentences in terms of the musical properties; the composition conditions include musical sentence symbols covering a series of plural musical sentences in a musical piece and being indicative of degrees of similarity among the musical sentences in terms of the musical properties; and the retrieval means includes substitution means which, when the sentence symbols included in the musical template are not identical with the sentence symbols included in the inputted composition conditions comparing sentence by sentence, extracts a musical template having the sentence symbols which are substitutable for the sentence symbols in the inputted composition conditions according to a predetermined rule. A musical template having sentence symbols which are similar to the sentence symbols in the composition conditions with respect to the respectively corresponding sentences will be extracted as a candidate template. Further, if any of the sentences in a musical template are substituted by other sentences within the same musical template and if the sentences of the musical template become identical or similar to the corresponding sentences of the composition conditions in terms of sentence symbols, then such a musical template will be extracted as a candidate template.

In another preferable specific construction of the above aspect: the musical segments constitute musical phrases; the subsets of data include data indicative of the number of phrases; the composition conditions include the number of phrases; and the retrieval means includes means which, when the number of phrases in the template is not equal to the number of phrases in the composition conditions, extracts a musical template after modifying the template under comparison with the composition conditions to have the same number of phrases as the composition conditions. In case there are a plurality of phrases both in the musical template and the composition conditions, the last phrase in the template for the phrase position in the template corresponding to the last phrase in the composition conditions will be employed to make a candidate template.

In further preferable specific construction of the above aspect: the musical segments constitute musical measures; the subsets of data include data indicative of the number of measures; the composition conditions include the number of measures; and the retrieval means includes means which, when the number of measures in the template is greater than the number of measures in the composition conditions, extracts a musical template after modifying the template under comparison with the composition conditions to have the same number of measures as the composition conditions, but when the number of measures in the template is less than the number of measures in the composition conditions, does not extract the template as a candidate. In case there are more measures in the musical template than in the composition conditions, the last measure in the template will be employed for the measure position in the template corresponding to the last measure in the composition conditions, but when there are less measures in the musical template than in the composition conditions, such template will not be extracted as a candidate template.

According to another aspect of the present invention, an automatic music composing apparatus comprises: a word input means for inputting words for a musical piece to be composed; construction information extracting means for extracting information representing a construction for the musical piece from the inputted words; a template data base storing a plurality of musical templates each including a set of data defining a musical piece, the set of data including data representing the musical construction of the musical piece; input means for inputting composition conditions including requirements on musical properties for a musical piece to be composed; retrieval means for searching the template data base to extract a candidate musical template which includes the data indicative of the construction of the musical piece which is identical with or similar to the construction represented by the words and the composition conditions; and composition means for composing a musical piece which meets the inputted words and composition conditions based on the extracted candidate musical template.

According to further aspect of the present invention, there is provided a computer readable medium on which is stored a computer program for composing a musical piece, and the computer program comprises program instructions which, when read and executed by a computer system, configure the computer system to perform the steps of: providing a template data base including a plurality of musical templates each including a set of data defining a musical piece, the musical piece being subdivided into a plurality of musical segments, the set of data including subsets of data respectively defining musical properties of the musical segments; inputting composition conditions including requirements on musical properties for a musical piece to be composed; searching the template data base to extract a candidate musical template which includes the subset of data indicative of the musical properties which meet the musical properties required by the inputted composition conditions; and composing a musical piece based on the extracted candidate musical template.

According to still further aspect of the present invention, there is provided a computer readable medium on which is stored a computer program for composing a musical piece, and the computer program comprises program instructions which, when read and executed by a computer system, configure the computer system to perform the steps of: inputting words for a musical piece to be composed; extracting information representing a construction for the musical piece from the inputted words; providing a template data base including a plurality of musical templates each including a set of data defining a musical piece, the set of data including data representing the musical construction of the musical piece; inputting composition conditions including requirements on musical properties for a musical piece to be composed; searching the template data base to extract a candidate musical template which includes the data indicative of the construction of the musical piece which is identical with or similar to the construction represented by the composition conditions; and composing a musical piece which meets the inputted words based on the extracted candidate musical template.

BRIEF DESCRIPTION OF THE DRAWINGS

For a better understanding of the present invention, and to show how the same may be practiced and will work, reference will now be made, by way of example, to the accompanying drawings, in which:

FIG. 7 is a table showing the substitution rules used in the phrase substitution processing in the present invention;

FIG. 11 is a table showing the substitution rules used in the measure substitution processing in the present invention;

FIG. 15 is a chart showing an example of how the data are generated and stored in the pre-arranged locations in the RAM in the present invention.

DESCRIPTION OF THE PREFERRED EMBODIMENTS

1. Structure of the Embodiment

Figure 1:
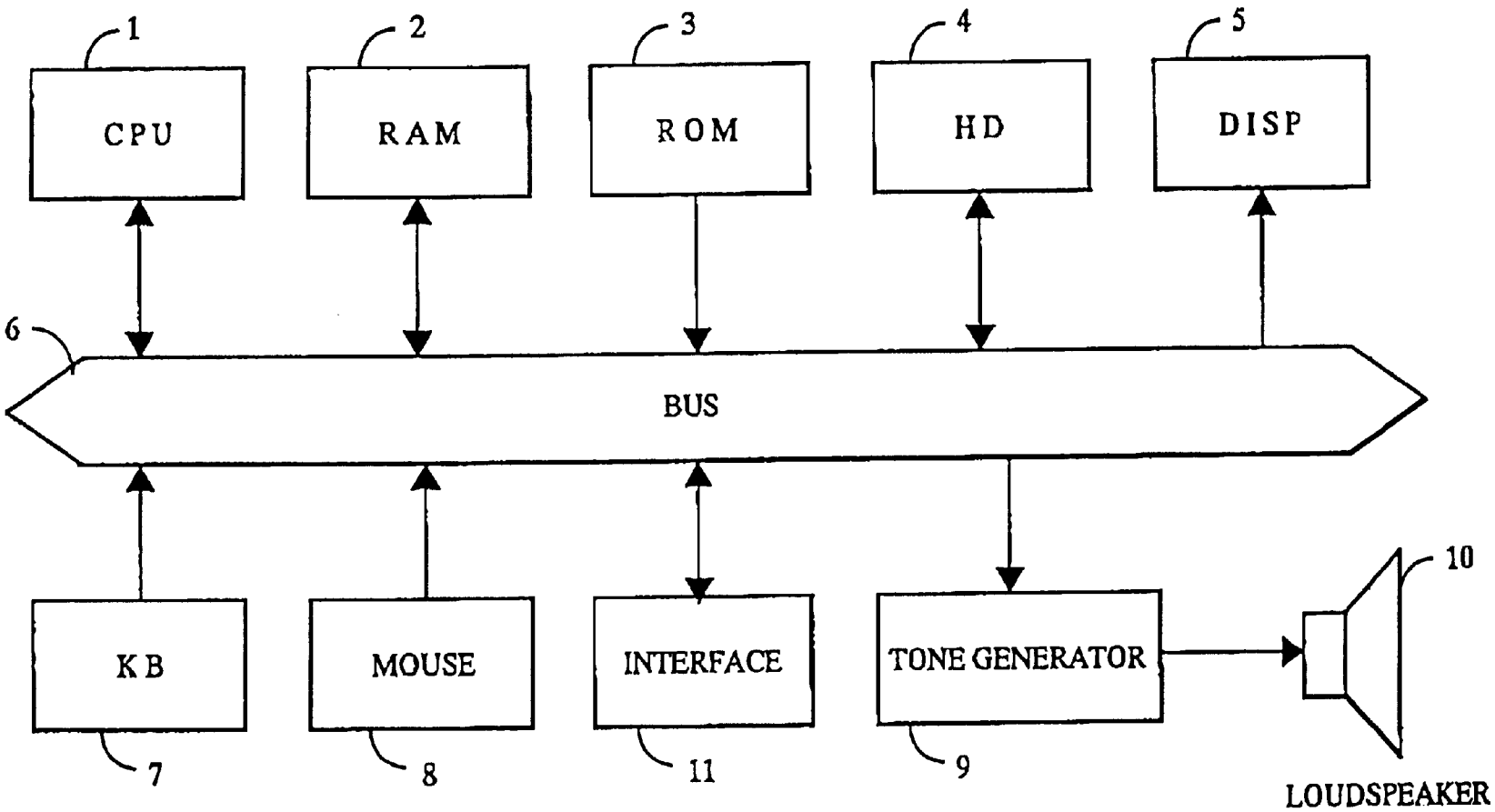
FIG. 1 is a block diagram showing a general hardware construction of an embodiment of an automatic music composing apparatus according to the present invention.

Illustrated in FIG. 1 of the drawings is a general block diagram showing the hardware structure of an embodiment of the present invention comprising a CPU 1 which controls other components in accordance with the processing programs to be described hereinafter, a RAM 2 and a ROM 3 to be accessed by the CPU 1 via a system bus 6. The ROM 3 stores an initial program loader, etc.

The component 4 denotes a mass storage device such as a hard disk drive (HD), a floppy disk drive, a CD-ROM (compact disk read only memory) drive, a magneto-optical disk (MO) drive, and a DVD (digital multipurpose disk) device, in which are placed storage media (e.g. a hard disk, a floppy disk, a CD-ROM and a magneto-optical disk) storing an operating system, application softwares (control programs) or various data. The softwares (including programs and data) will be expanded on the hard disk first and then on the RAM, or directly on the RAM 2 for data processing. Some of the softwares may be stored in the ROM 3 and be used from the ROM 3, but will preferably be installed in a rewritable storage device such as a hard disk so that an addition to or a version-up of the control programs may easily be made.

The component 5 denotes a display device such as a CRT and an LCD to display various information in the system operation under the control of the CPU 1. Further included in the system of FIG. 1 are a keyboard 7, a pointing device 8 such as a mouse and a tablet, a tone generator 9 for producing or synthesizing musical tone signals based on the performance data supplied from the CPU 1, a sound system 10 for producing audible sounds from the synthesized tone signals from the tone generator 9, and an interface device 11 such as a MIDI (musical instrument digital interface) to be connected with an external apparatus.

2. Function of the Embodiment

Figure 2:
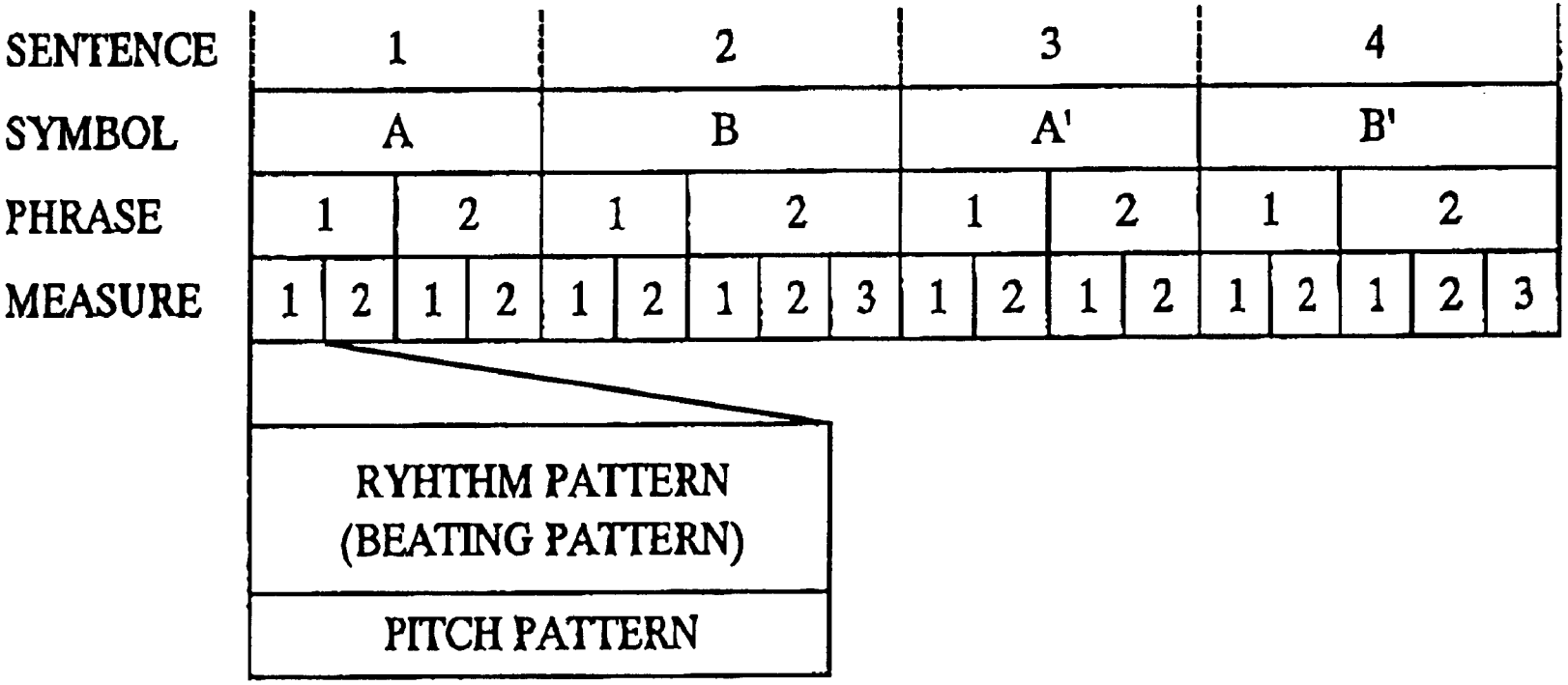
FIG. 2 shows a data structure in a musical template used in the present invention.

Hereinbelow will be described how the embodiment having the above-mentioned structure functions according to the present invention. The automatic music composing apparatus of this embodiment is to select "musical templates" in accordance with musical conditions (composition conditions) including musical features and words (for a song) and then to generate a melody piece (musical piece) based on the selected template(s) automatically. An example of the data structure of a musical template in this embodiment is illustrated in FIG. 2. One template corresponds to a piece of music in its entirety, and comprises melody data (including a pitch pattern and a rhythm pattern) which constitute a melody (in this embodiment), feature information for an overall structure of a musical piece which defines the characters of the overall musical piece, and feature information for respective musical sentences each of which defines the characters of each sentence. An entire musical piece has a hierarchical structure consisting of a sentence level, a phrase level and a measure level, from high to low in the order mentioned. For example, in FIG. 2, the entire musical piece has four sentences from first to fourth, the first sentence has two phrases from first to second, the first phrase has two measures from first to second, and the first measure comprises a melody segment defined by a pitch pattern (a progressive pattern of notes having pitches) and a rhythm pattern (a progressive pattern of beatings or pulsations having time intervals).

The sentence symbols such as A, B, A' and A" shown in FIG. 2 are systematically symbolized to indicate the similarity of the respective musical sentences in terms of feature information and melody construction (i.e. phrase construction, measure construction, pitch and rhythm pattern to constitute a melody segment). For example, the sentences having different alphabetic letters such as <A> and <B>, respectively, are obviously different in melody and musical feature, while the sentences having a same alphabetic letter and being differentiated by primes such as <A>, <A'> and <A">, respectively, are similar in melody and musical feature to some extent but are not strictly equal to each other, namely the latter three have many common points in note progression arrangement and musical feature. Generally speaking, the more the number of primes is different, the more different the melodies and features are among the sentences. For example, the sentence symbolized as <A'> is closer to the sentence symbolized as <A> than the sentence symbolized as <A"> is to the sentence symbolized as <A>. Each musical template carries feature information as mentioned before, such as information regarding the meter, the musical genre (e.g. 8-beat), the scale mode (major/minor), the melody fluency (melodic/rhythmic or fluent/beating), the tempo (speed), the width of note range, the shortest note duration and the number of sentences for an overall musical piece, and information regarding the number of phrases, the similarity symbols for the respective sentences and the head/tail chord pair for each sentence, and information regarding the number of measures for each phrase, and information regarding the number of syllables for each measure.

2-1. Composition Processing (in General)

The composition processing using musical templates will be explained hereinbelow with reference to FIG. 3, which shows a flowchart illustrating the flow of composition conditions inputting process and the flow of melody generation process in the embodiment of an automatic music composing apparatus according to the present invention. As seen from this flowchart, the automatic music composing apparatus initially judges whether there will be words to be attached to the musical piece which the apparatus is now going to compose based on the instructions inputted by the user through the keyboard 7 or the pointing device 8. In case words are to be attached to the musical piece, the user inputs the words at step SA2, and then after completion of inputting the words, the apparatus detects a possible structure (the number of sentences, the number of phrases in each sentence, the number of measures in each phrase and the number of syllables in each measure) for the musical piece based on the inputted words at step SA3. It should be understood here that a series of the words includes therein partition marks at respective intended partition positions between sentences, phrases, measures and so forth, and that step SA3 detects these partition marks for constructing a structure for the music composition. Following step SA3 of structure detection, or subsequent to the judgment answer "NO" at step SA1, the process moves forward to step SA4 for letting the user input his/her desired composition conditions. The composition conditions include general composition conditions for the overall musical piece (overall composition conditions) and specific composition conditions for each musical sentence (sentence composition conditions). Now in case no words are inputted at step SA2 or no structure are detected at step SA3, the step SA3 may include an additional process of manually inputting the structure for the music composition such as the number of sentences, the number of phrases for each sentence, the number of measures for each phrase and the number of notes for each measure.

Upon completion of inputting the music composition conditions, the process moves forward to step SA5 for extracting candidate musical templates which fit the structure detected from the words, the inputted general composition conditions and inputted sentence composition conditions. This process of extracting the candidate musical templates is the one that is unique to the present invention, and includes recombining (replacing or substituting) the segments (elements) in a template to create an available template which meet the requirements of the inputted composition conditions and the structure. This process at step SA5 will be described in full details later as this process is the most characteristic idea of the present invention. Then step SA6 selects one of the extracted candidate musical templates for further work (embellishment, supplementation, enhancement, addition, subtraction, etc). Thereafter, step SA7 determines a rhythm pattern to be employed by fitting the number of syllables in the melody of the selected candidate musical template to the number of syllables on the words or the inputted number of notes. Then, step SA8 determines the pitches for the respective notes and step SA9 modifies the melody according to necessity before finally output the composed musical piece. Thus, on the RAM 2 will be created information (musical parameters to determine musical properties) for defining a musical piece including a melody and other features and properties.

2-2. Candidates Extracting Processing

The step SA4 of extracting the candidate templates in FIG. 3 include a main and unique idea in the composition processing of the present invention, and therefore the process of extracting the candidate templates will be described in the following. FIG. 4 is a chart showing how candidate templates will be extacted by the apparatus of this embodiment, and illustrates one set of input conditions (in this explanation, the conditions are similarity symbols for the respective sentences) for a musical piece and five musical templates with the assigned sentence symbols in correspondence to the inputted set. The five templates shown in the chart are those which have been judged to have overall features which match the inputted overall features represented by the composition conditions.

In the Figure, the uppermost template (1) consists of four sentences respectively having sentence symbols <A>, <A'>, <B> and <A"> all of which are correspondingly identical with the four symbols in the inputted conditions (fully equal), and therefore, is of course extracted as a candidate through the extracting process. The second template (2) consists of four sentences respectively having sentence symbols <A>, <A'>, <B> and <A> the former three of which are correspondingly equal to the former three symbols in the inputted conditions and the last one of which is not exactly equal to the last symbol in the inputted condition. But, by substituting the second sentence having a symbol <A'> for the fourth sentence having a symbol <A>, this template will have a series of sentence symbols <A>, <A'>, <B> and <A'> which as a whole are more similar to the inputted series of sentence symbols (substitutably equal), and therefore can be extracted as a candidate through the extracting process. The third template (3) consists of four sentences respectively having sentence symbols <A>, <A'>, <A"> and <B>of which the former two are correspondingly equal to the former two symbols in the inputted composition conditions and the latter two reversely corresponds to the latter two symbols in the inputted conditions. But, by interchanging the third and fourth sentences (including not only the symbols, but also all musical parameters of the respective sentences) with each other, this template will have a series of sentence symbols <A>, <A'>, <B> and <A"> of which all are identical to the inputted series of sentence symbols (substitutably equal), and therefore can be extracted as a candidate through the extracting process. The fourth template (4) consists of four sentences respectively having sentence symbols <A>, <A>, <B> and <C> of which the first is equal to the first symbol in the inputted conditions, the second is similar to the second symbol <A'> in the inputted conditions, the third is equal to the third symbol in the inputted conditions, and the fourth is different from the fourth symbol <A"> in the inputted conditions But, by canceling the fourth sentence having a symbol <C> in this template and substituting the first sentence having a symbol <A> in this template for the canceled fourth sentence, this template will have a series of sentence symbols <A>, <A>, <B> and <A> which as a whole are more similar to the inputted series of sentence symbols (substitutably equal) than the original series of <A>, <A>, <B> and <C>, and therefore thus modified (replaced) template can be extracted as a candidate template through this process. The fifth template (5), however, consists of four sentences respectively having sentence symbols <A>, <A'>, <A> and <A"> of which the first, the second and the fourth symbol are respectively identical to the corresponding sentence symbols in the inputted conditions but the third symbol <A> is different from the third sentence symbol <B> in the inputted conditions, and yet there is no <B> or similar one in this template for substitution use (neither identical nor similar, i.e. useless), and therefore cannot be extracted as a candidate template through this process (unsubstitutable). More detailed explanation about tile judgment process for equal/unequal (or similar/dissimilar) judgment and the substitution process will be made in the following, referring to FIGS. 4 through 6.

Figure 5:
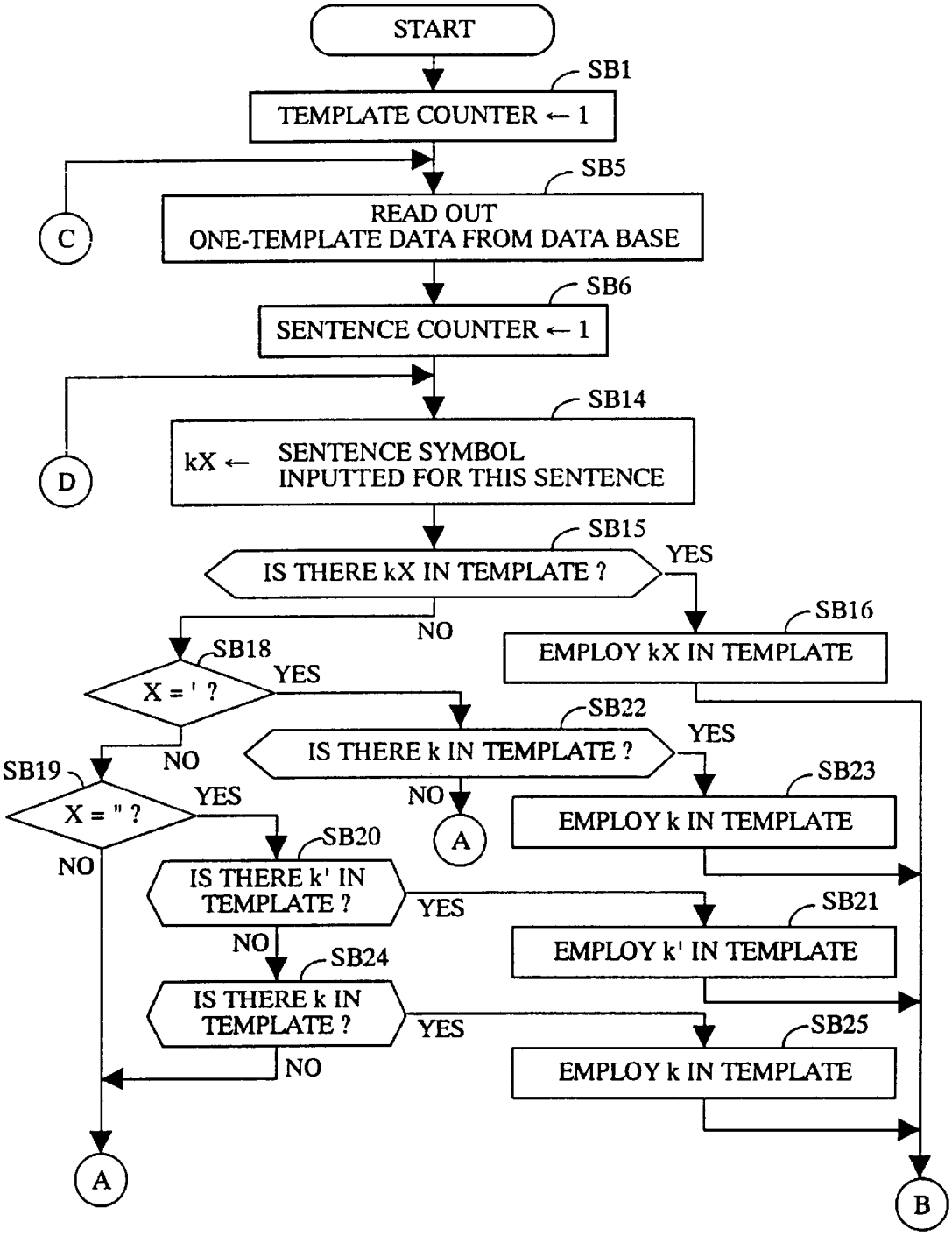
FIGS. 5 and 6 in combination is a flowchart showing an example of the process flow for judgment processing and substitution processing with respect to a musical template in the present invention.
Figure 6:
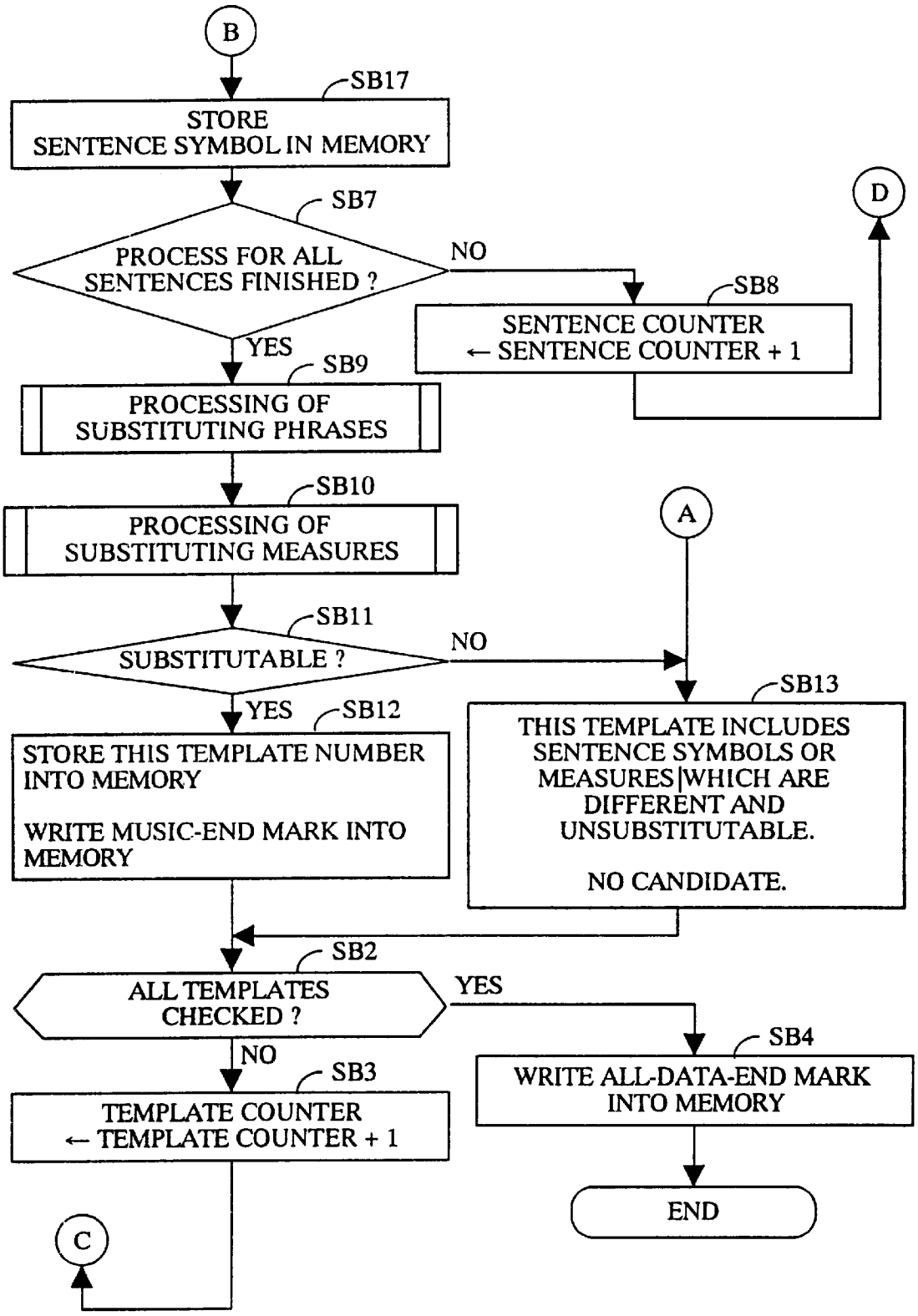

FIGS. 5 and 6 in combination is a flowchart showing an example of the process flow for judgment processing and substitution processing with respect to a musical template, wherein the connection points A, B, C and D in the both drawings are respectively connected with tile same lettered points to make a larger size of a combined flowchart. This flowchart is a subroutine for step SA5 in FIG. 3.

Referring to FIGS. 5 and 6 in combination, upon start of this subroutine, the automatic music composing apparatus of this embodiment initially puts the value "1" into the musical template counter at step SB1. Thereafter, this template counter value will be incremented by "1" at step SB3 every time the judgment and substitution processing for one template is completed, until the processing from step SB5 through step SB12 or SB13 is performed for all of the templates in the data base. When the judgment and substitution processing is completed for all the templates, the process moves forward to step SB4 to write an all-data-end mark (a data-end mark which indicates the completion of the processing on all data) into the predetermined area in the RAM 2 before going forward to step SA6 in FIG. 3.

Hereinbelow is described the judgment and substitution processing with respect to a musical template read out from the data base at step SB5 in detail. The explanation will be first made about common processes which are conducted independent of the specific inputted conditions or the specific read-out templates, and next about specific processes which are conducted dependent on the inputted conditions or the read-out templates.

2-2(a). Common Processes

After reading out a musical template from the data base at step SB5, the apparatus first conducts step SB6 to put the value "1" into a sentence counter which is a variable indicating the musical sentence to be compared with the inputted condition so that the judgment and substitution will take place with respect to the first sentence. Subsequent sentences will thereafter be taken care of one after another through the steps SB14 through SB12/SB13 until the comparison with respect to the last sentence (in this figure, the fourth sentence) will be over, with the sentence counter being incremented one by one per sentence at step SB8. When all the sentences have been compared, step SB7 says "YES" and the processing moves forward to step SB9 to perform a phrase substituition process and then to step SB10 to perform a measure substitution process, and when both of the substitution processes have been cleared (successful, i.e. fully equal or substitutably equal), i.e. step SB11 says "YES", the template which has just been examined is now determined as a candidates and then the template number will be written in the predetermined region of the RAM 2 and also the musical-piece-end mark indicating a partition between aligned candidates will be written in the predetermined region of the RAM 2 at the proper timing at step SB12. Then the processing moves forward to step SB2. On the contrary, when it has turned out that there is no substitutable sentence in the template under examination for any of the inputted conditions before all of the sentences have been examined (i.e. no possibility of substitution) or when either of the substitution processes has not been cleared (unsuccessful i.e. useless), i.e. step SB11 says "NO", the template which has just been examined is now determined not to be a candidate, and then the template number will not be written in the RAM, as this template includes sentence symbols or measures which are different and not substitutable. The processing then goes forward to step SB2. At step SB13, however, if the data concerning the just examined template has been stored in the predetermined region in the RAM 2 before, such stored data will be canceled.

The rules of sentence employment are as follows.

(1) With respect to each sentence in the inputted conditions, if the similarity symbol of the corresponding sentence in the template under examination is identical with the symbol of the corresponding sentence in the inputted conditions, this sentence in the template shall be employed as it is. (Employed as identical)

(2) With respect to each sentence in the inputted conditions, if the similarity symbol of the corresponding sentence in the template under examination is not identical with the symbol of the corresponding sentence in the inputted conditions but another sentence in the template has the same symbol, then the said another sentence in the template shall be employed as a substitute for the said corresponding sentence (Employed by substitution)

(3) With respect to each sentence in the inputted conditions, if the similarity symbol of the corresponding sentence in the template under examination is of the same kind (same alphabetic letter) of symbol as but with the fewer number of primes than the symbol of the corresponding sentence in the inputted conditions, i.e. of a similar symbol thereto, then the said sentence in the template shall be employed as it is. (Employed as similar)

(4) With respect to each sentence in the inputted conditions, if the similarity symbol of the corresponding sentence in the template under examination is not similar to the symbol of the corresponding sentence in the inputted conditions but another sentence in the template has a similar symbol, then the said another sentence in the template shall be employed as a substitute for the said corresponding sentence. (Employed as similar by substitution)

In the case where either of the above rules (2) or (4) is applicable, a sentence in the template carrying a different symbol from that of the corresponding sentence in the inputted conditions is substituted by another sentence having the identical or a similar symbol to that of the corresponding sentence in the inputted conditions, and therefore there may be a chance in which a musical template which includes different sentence feature information not found in the inputted conditions is employed as a candidate template.

2-2(b). Specific Processes

The processing from step SB14 onward includes processes specific to the respective cases. First, an explanation will be on the general matters, and next on five cases, case by case. Case (1) through (4) are the cases where the judgment rules that the templates are equal or similar to the inputted conditions, whereas case (5) is the case where the judgment rules that the template is not similar and useless for a candidate.

General Flows

At step SB14, the similarity symbol (e.g. <A>) of the subject sentence (initially, is the first sentence) in the inputted composition conditions is put into the variable kX. Next step SB15 judges whether the musical template under examination includes a sentence having a similarity symbol which is the same as the content of the variable kX (eg <A>). If there is such a sentence in the template, the judgment says "YES" irrespective of the location of the sentence in the musical piece of the template. The location need not be the same as the subject sentence in the inputted composition conditions. If the judgment result is "YES", the processing moves to step SB16, while if the judgment result is "NO", the processing moves to step SB18 as seen in FIG. 5. At step SB16, the sentence having the same symbol kX in the template as the symbol kX of the subject sentence in the composition conditions is employed for the subsequent processes, and this sentence symbol kX is stored in the RAM 2 at step SB17.

In the case where there is no sentence having the same sentence symbol in the template as the sentence symbol of the subject sentence in the composition conditions, a judgment will be made whether the prime byte (portion) X of the variable kX is a single prime <'> or not at step SB18. If the answer is "YES", the next judgment is to check whether there is in the template a sentence having the sentence symbol which is the same as the variable k (i.e. kX with X being modified from <'> to null) or not at step SB22. If the answer is "YES", such a sentence having the symbol k is employed for the subsequent processes at step SB23, and this sentence symbol k is stored in the RAM 2 at step SB17. If the answer of step SB22 is "NO", there is no substitutable sentence in the template, and thus this musical template shall not be employed as a candidate at step SB13. The process moves to step SB2.

In case step SB18 judges "NO", a further judgment will be made whether the prime byte (portion) X of the variable kX is a double prime <"> or not at step SB19. If the answer is "YES", the next step SB20 checks whether there is in the template a sentence having the sentence symbol which is the same as the variable k' (kX with X being modified from <"> to <'>) or not. If the answer here is "YES", the said sentence having the symbol k' is employed for the subsequent processes at step SB21, and his sentence symbol k' is stored in the RAM 2 at step SB17. This means that in case the sentence symbol of the subject sentence in the composition conditions is k" and there is no k" sentence in the template but there is a k' sentence anywhere in the template, then the sentence having the symbol k' in the template shall be employed in place of k" sentence for the candidate template. In case the step SB20 judges "NO", the next judgment is as to whether there is in the template a sentence having a symbol which is the same as the variable k at step SB24. If the answer is "YES", the said sentence having the symbol k shall be employed for the candidate template, and this sentence symbol k is stored in the RAM 2 at step SB17. This means that in case the sentence symbol of the subject sentence in the compositions is k" and there is neither k" sentence nor k' sentence in the template but there is a k sentence anywhere in the template, then the sentence having symbol k in the template shall be employed in place of k" sentence for the candidate template. To summarize, when the composition condition requires the subject sentence should be with a symbol k" but there is no sentence with the symbol k in the template, the processing is conducted first to find a sentence with a symbol k' and, when found, employs that sentence with the symbol k', whereas when not found, the processing is further conducted to find a sentence with a symbol k and, when found, employs that sentence with the symbol k.

If the answer of step SB24 is "NO", there is no substitutable sentence in the template, and thus this musical template shall not be employed as a candidate at step SB13. The process moves to step SB2. Also when the answer of step SB19 is "NO", there cannot be a substitutable sentence in the template, and thus this musical template shall not be employed as a candidate at step SB13. The process moves to step SB2.

Specific Flows

Hereinbelow is described the process flows with respect to the specific cases, case by case, using example musical templates. It is assumed here that the inputted composition conditions are to compose a musical piece including four sentences respectively having sentence feature symbols (in terms of similarity) A, A', B and A".

Case (1): where the template consists of A, A', B and A" sentences

FIG. 4 shows this case at "musical template (1)". First, with respect to the first musical sentence, the sentence symbol of the subject sentence in the inputted composition conditions is <A> and the sentence symbol of the first sentence in the musical template is also <A>, and therefore the process flows through steps SB14, SB15 and SB16 to employ this sentence with the symbol <A>. Likewise, with respect to the second, third and fourth sentences, each corresponding sentence has the same symbol with each other in the template and in the conditions, and therefore the process flows through steps SB14, SB15 and SB16 to employ the sentences with the symbols <A'>, <B> and <A">, respectively. Thus, all of the sentences in the musical template are employed as a candidate template. The process passes through steps SB17 and SB18 to go to step SB9 to perform the processing for the phrase level in the hierarchical structure of the musical piece.

Case (2): where the template consists of A, A', B and A sentences

FIG. 4 shows this case at "musical template (2)". With respect to the first, second and third sentences, each corresponding sentence has the same symbol in the composition conditions and in the musical template with each other, and therefore the process flows through steps SB14, SB15 and SB16 to employ the sentences with the symbols <A>, <A'> and <B">, respectively. What is different from the case (1) is the processing for the fourth sentence. While the sentence symbol of the fourth sentence in the inputted composition conditions is <A">, there is in the template no sentence having the symbol <A">. Step SB15 therefore judges "NO", and step SB18 also judges "NO", and the process proceeds to step SB19. There, the judgment will be "YES", and as there is a sentence having the symbol <A'> in the template, step SB20 judges "YES", and consequently step SB21 employs this sentence with <A'> symbol in place of the original fourth sentence with <A> symbol. Thus <A"> is substituted for <A>, as <A'> is more similar to <A"> than <A> is to <A'>. After all with this template under examination, a candidate template has thus been established (by substitution) using sentences all from the original template. The candidate template is now judged to be useful in terms of sentence symbols, and then will be subject to the further processing with respect to the lower hierarchical level "phase" at step SB9.

Case (3): where the template consists of A, A', A" and B sentences

FIG. 4 shows this case at "musical template (3)". With respect to the first and second sentences, each corresponding sentence has the same symbol in the composition conditions and in the musical template with each other, and therefore the process flows through steps SB14, SB15 and SB16 to employ the sentences with the symbols <A> and <A'>, respectively. What is different from the case (1) is the processing for the third and fourth sentences. Although the sentence symbols for the third and fourth sentences in the template under examination are not the same as the corresponding third and fourth sentences in the composition conditions, respectively, the same symbols <B> and <A'> are found at other sentence positions in this musical template. Namely, the symbol <B> of the third sentence in the composition conditions is found at the fourth sentence in the template, and the symbol <A"> of the fourth sentence in the composition conditions is found at the third sentence in the template. Accordingly, the processing flowing through steps SB14, SB15 and SB16 employs the musical sentences respectively having symbols <B> and <A"> from within the template under examination. As a result, with this template under examination, a candidate template has thus been established (by substitution) using sentences all from the original template. The candidate template is now judged to be useful in terms of sentence symbols, and then will be subject to the further processing with respect to the lower hierarchical level "phrase" at step SB9.

Case (4): where the template consists of A, A, B and C sentences

FIG. 4 shows this case at "musical template (4)". With respect to the first and third sentences, each corresponding sentence has the same symbol in the composition conditions and in the musical template with each other, and therefore the process flows through steps SB14, SB15 and SB16 to employ the sentences with the symbols <A> and <B>, respectively. With respect to the second sentence, the composition conditions denote a symbol <A'>, but there is no sentence having the symbol <A'> in the template. Therefore, the judgment at step SB15 rules "NO", and at step SB18 "YES", and next at step SB22 the judgment will be "YES" as there are <A> sentences at the first and second sentences in the template, and accordingly step SB23 employs the sentence having the symbol <A> in the template under examination for the second sentence for a candidate template. With respect to the fourth sentence, the composition conditions denote a symbol <A">, but there is no sentence having the symbol <A"> in the template. Therefore, steps SB15 and SB18 both judge "NO" to proceed to step SB19. As the symbol under examination is <A">, step SB19 now judges "YES" and the process moves to step SB20. While there is no <A'> sentence in the template under examination, step SB20 judges "NO". But as the template includes <A> symbol in the first and second sentences, instead, step SB24 judges "YES" to direct the process flow to step SB25, where the sentence having the symbol <A> is employed to use for the fourth sentence, and the symbol <A> is stored for the fourth sentence in the memory at step SB17. As all of the sentences have been determined available (including by substitution), step SB7 directs the process to proceed to step SB9 for the phrase level processing.

Case (5): where the template consists of A, A', A and A" sentences

FIG. 4 shows this case at "musical template (5)". With respect to the first and second sentences, each corresponding sentence has the same symbol in the composition conditions and in the musical template with each other, and therefore the process flows through steps SB14, SB15 and SB16 to employ the sentences with the symbols <A> and <A'>, respectively as in the case (1) above. What is different from the case (1) is the processing for the third sentence. While the symbol for the third sentence in the composition conditions is <B>, there is no sentence having the letter portion of <B> in this template (5). Therefore, the judgments at steps SB15, SB18 and SB 19 are all "NO", and the process flow moves forward to step SB13, where it is determined that this musical template is not suitable for a candidate in regard to the sentence symbols, i.e. "unsubstitutable in the sentence level". Then the process goes forward to step SB2. There will be no check with respect to the fourth sentence in this case.

2-3. Phrase Substitution Processing

For the selected candidate musical template according to the sentence level judgements, step SB9 (in FIG. 6) conducts processing of substituting phrases as the next lower level in the hierarchical structure of a music. Hereinafter will be described the processing of phrase substitution referring to a flowchart of the subroutine for step SB9. To begin with, the rules used in this processing is explained with reference to FIG. 7. FIG. 7 is a table showing the relationship between the phrases included in a sentence in the inputted composition conditions and the phrases to be employed in the corresponding sentence of the selected (at sentence level) candidate template This table shows the patterns of phrase substitution for each of the numbers of phrases included in one sentence in the inputted conditions according to the cases enumerated in the following items A$–C$.

(A$) Where a sentence in inputted conditions includes one phrase

In this case, whether the subject sentence in the musical template under processing includes one phrase (i.e. only first phrase=@1), or two phrases (i.e. first and second phrases=@1 and @2), or three phrases (i.e. first, second and third phrases=@1, @2 and @3), the first phrase @1 in the template shall be employed ("substituted" by itself in wider sense) for the first phrase of work output of this processing.

(B$) Where a sentence in inputted conditions includes two phrases In this case, the general expression of the rules is (1) to employ the first phrase in the template sentence for the first phrase of work output, and (2) to employ the last phrase in the template sentence for the second phrase of work output. But specifically, there are three different patterns of determination depending on the number of phrases included in the subject sentence of the musical template under processing as follows.

(B$-1) Where the subject sentence of the template has only one phrase

In this case, the single phrase @1 in the subject sentence shall be employed (substituted) for the first phrase of work output (as requested by the inputted conditions), and the same single phrase @1 (as the last one of the one) shall be employed (substituted) for the second phrase of work output.

(B$-2) Where the subject sentence of the template has two phrases

In this case, the first phrase @1 in the subject sentence shall be employed (substituted) for the first phrase of work output, and the second phrase @2 (as the last one of the two) shall be employed (substituted) for the second phrase of work output.

(B$-3) Where the subject sentence of the template has three phrases

In this case, the first phrase @1 in the subject sentence shall be employed (substituted) for the first phrase of work output, and the third phrase @3 (as the last one of the three) shall be employed (substituted) for the second phrase of work output (C$) Where a sentence in inputted conditions includes three phrases In this case, there are three different patterns of determination depending on the number of phrases included in the subject sentence of the musical template under processing as follows.

(C$-1) Where the subject sentence of the template has only one phrase

In this case, the single phrase @1 in the subject sentence shall be employed for the first phrase of work output (as requested by the inputted conditions), the same single phrase @1 in the subject sentence shall be substituted for the second phase of work output, and the same single phrase @1 (as the last one of the three) shall be substituted for the third phrase of work output.

(C$-2) Where the subject sentence of tie template has two phrases

In this case, the first phrase @1 in the subject sentence shall be employed for the first phrase of work output, the second phrase @2 in the subject sentence shall be employed for the second phrase of work output, and the second phrase @2 (as the last one of the three) shall be substituted for the third phrase of work output.

(C$-3) Where the subject sentence of the template has three phrases

In this case, the first phrase @1 in the subject sentence shall be employed for the first phrase of work output, the second phrase @2 in the subject sentence shall be employed for the second phrase of work output, and the third phrase @3 (as the last one of the three) shall be employed for the third phrase of work output.

2-3(a). Common Processes

Figure 8:
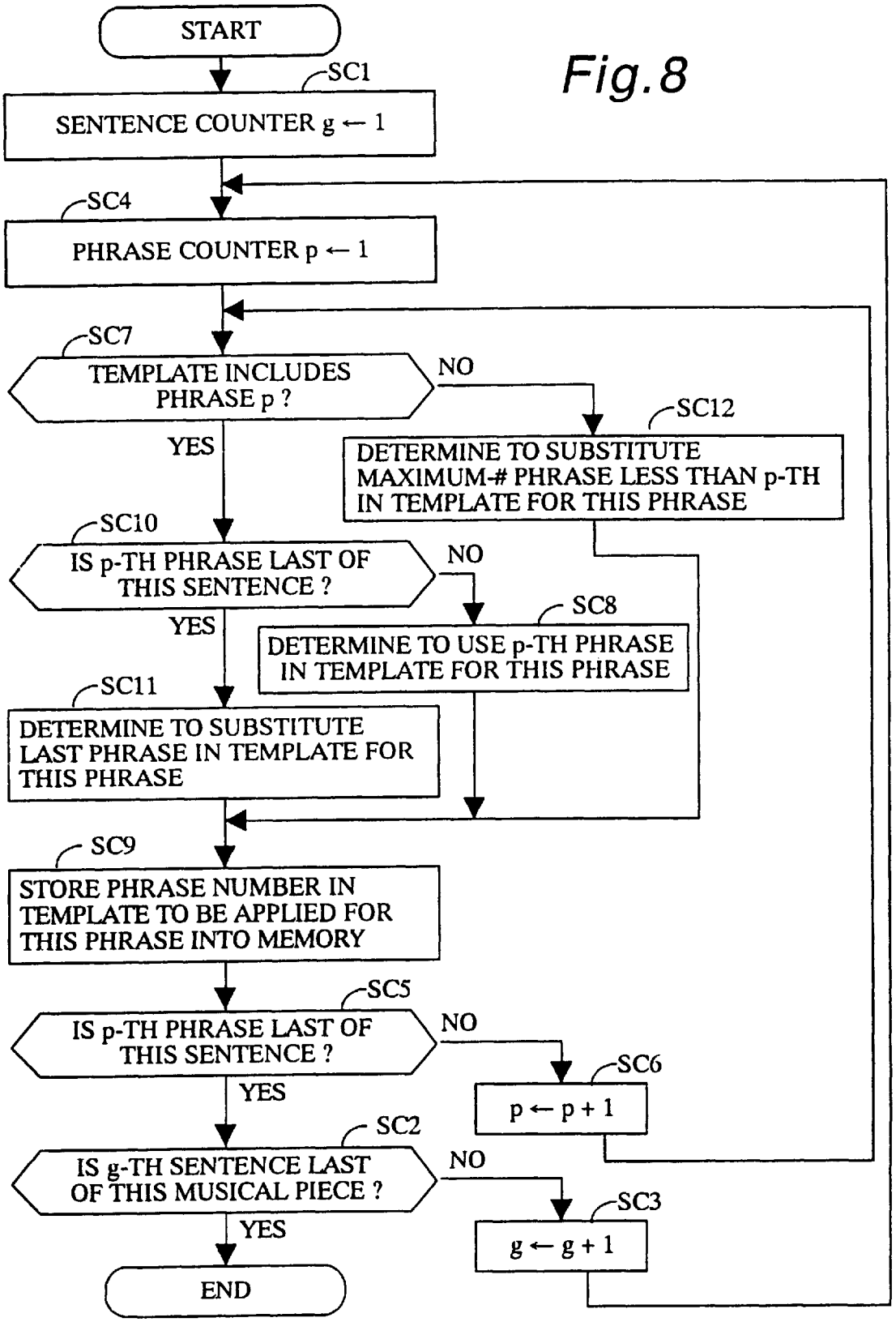
FIG. 8 is a flowchart showing a process flow for phrase substitution processing in the present invention.

FIG. 8 is a flowchart showing a process flow for phrase substitution processing in the present invention. As seen in this Figure, step SC1 initially puts a value "1" into the sentence counter "g" which is a variable identifying the subject sentence under processing. From step SC4 onward, the phrase substitution processing will be conducted for the phrases one after another in the subject sentence, with the sentence counter being incremented at steps SC2 and SC3 every time the phrase substitution processing has been completed for each subject sentence, until the phrase substitution processing will have been performed for the last sentence.

Step SC4 is to put a value "1" into the phrase counter p which is a variable identifying the subject phrase under processing, and steps SC7 and onward perform phrase substitution processing about each subject phrase, incrementing the phrase counter p at step SC6 every time the phrase substitution processing has completed for each subject phrase, until the phrase substitution processing will have been conducted for the last phrase in the subject sentence (being judged at step SC5). When the comparison processing (for substitution) will have been finished for the last musical sentence, the process moves forward to the measure substitution processing at step SB10 of FIG. 6.

2-3(b). Specific Processes

The processing from step SC7 onward includes processes specific to the given cases. An explanation will be made on the examples shown in FIGS. 9 and 10, in which each level of the hierarchical structure of the musical piece is aligned in the ascending order, eg. the sentences are aligned in the order of first, second, third, and so forth, the phrases in a sentence are in the similar order, and likewise are the measures in a phrase.

(b-1): Case of FIG. 9

Figure 9:
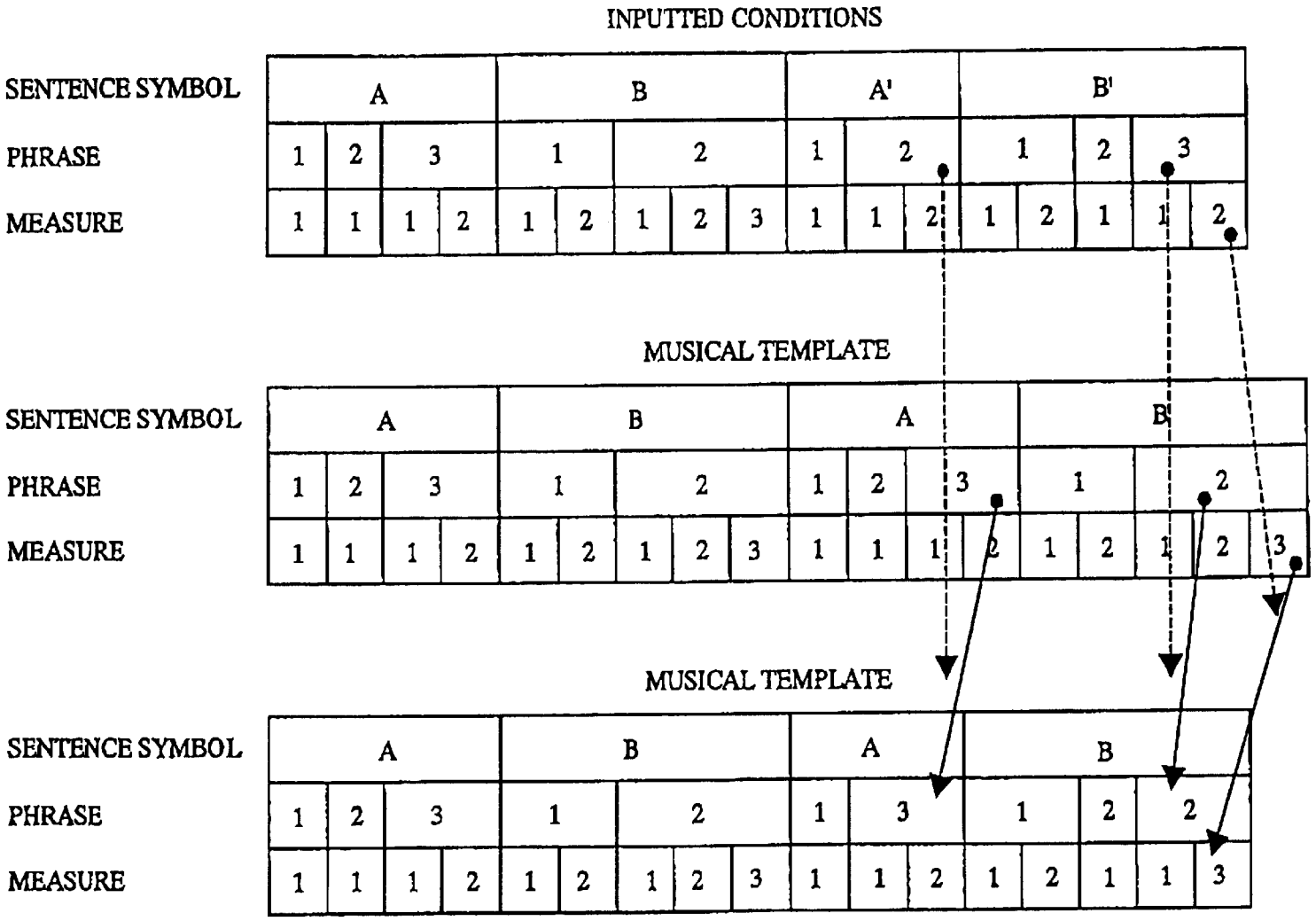
FIG. 9 is tables showing how the phrase substitution processing and the measure substitution processing will be conducted in the present invention.

In FIG. 9, each of the three tables shows the hierarchical structure of a musical piece. The top table represents an example of the inputted composition conditions. The middle table represents an example of a musical template selected as a candidate for further processing and being subject to the phrase substitution processing by checking about its availability as a candidate template for the further processing to compose a musical piece. The bottom table represents how the middle table is modified to meet the composition conditions to make a candidate template for the composition of a musical piece as a work output of the automatic music composing apparatus according to the present invention.

The fist process here is step SC7 which judges whether the subject phrase (to be examined), for example the first phrase, of the subject sentence, for example the first sentence, in the composition conditions exists in the subject musical template (to be examined). In this Figure, the musical template has phrase 1 in the first sentence, and accordingly the judgment result is "YES". As this phrase 1 is not the last phrase of the first sentence in the template, step SC10 judges "NO". Then, step SC8 determines to use this phrase 1 for the work output of this phrase substitution processing. Step SC9 then stores into the predetermined area in the RAM 2 this phrase number "1" which identifies the determined phrase in the template to be used for the corresponding phrase in the work output.

As the process proceeds to the second phrase in the first sentence, a similar procedure (to that for the first phrase) determines the phrase 2 in the template to be used for the subject phrase for the work output and stores the identifying number i.e. "2" in the predetermined area in the RAM 2 through steps SC7, SC10, SC8 and SC9. But for the third phrase, step 10 judges "YES ", and the process flow goes to step SC11 instead of step SC8 and determines the use of the last phrase in the first sentence of the template for the third phrase of the work output. In this situation, however, the last phrase happen to be the third phrase, and therefore step SC9 stores the identifying number "3" in the predetermined area in the RAM 2.

Then, as the process moves forward to the second sentence, similar processes to those for the first sentence as mentioned above will take place for this sentence.

When the process comes to the third sentence and when the subject phrase is the second phrase in the inputted conditions, the process will be a little bit different. Although step SC7 judges "YES", step SC10 judges "YES" and step SC11 determines the use of the last phrase, the last phrase does not happen to be the second phrase but happen to be the third phrase in this instance, and consequently step SC9 stores the identifying number "3" in the predetermined area in the RAM2 for the second phrase of the third sentence, just as seen in the bottom table in FIG. 9.

Next when the process comes to the fourth sentence and when the subject phrase is the third phrase in the inputted conditions, the process will be quite different. In this instance, there is no third phrase in the fourth sentence of the template, and accordingly the judgment at step SC7 results "NO" and the process moves forward to step SC12 to determine to use the maximum numbered phrase less than "3" for the third phrase. In this case, the phrase 2 is the largest numbered phrase of this fourth sentence in the template, and accordingly step SC12 determines to use phrase 2 of the fourth sentence in the template for the third phrase of the fourth sentence in the work output. That is to say, phrase 2 substitutes the phrase 3, and the final construction of the modified template (as a candidate to be sent to step SB10 in FIG. 6) will become as shown at the bottom table in FIG. 9. This determined phrase number "2" is then stored in the predetermined area in the RAM 2.

(b-2): Case of FIG. 10

Figure 10:
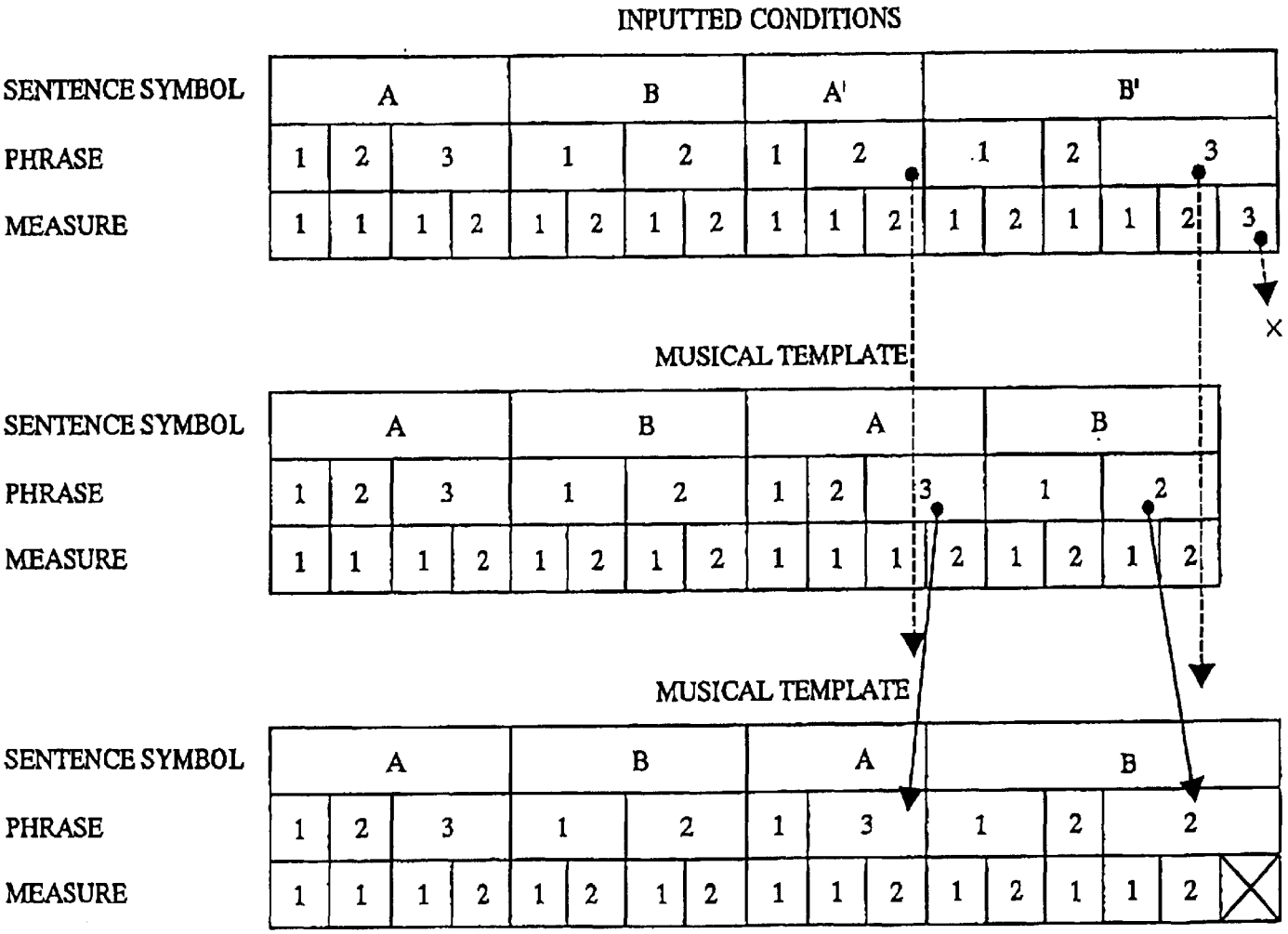
FIG. 10 is further tables showing how the phrase substitution processing and the measure substitution processing will be conducted in the present invention.

In FIG. 10, each of the three tables shows the hierarchical structure of a musical piece, just as in the case of FIG. 9. The top table represents an example of the inputted composition conditions. The middle table represents an example of a musical template subject to the phrase substitution processing by checking about its availability for a candidate template to compose a musical piece. The bottom table represents how the middle table is modified to meet the composition conditions to make a candidate template as a work output of this phrase substitution processing in the automatic music composing apparatus according to the present invention.

Although there are some differences in the number of measures in the hierarchical structure between FIG. 10 and FIG. 9, the structures in the level of the phrase are the same with each other. And therefore, determination as to the use of phrases with respect to FIG. 10 is quite the same as the case of FIG. 10.

2-4. Measure Substitution Processing

For the modified candidate musical template through the phrase level processing, step SB10 (in FIG. 6) conducts processing of substituting measures as the next lower level subjects in the hierarchical structure of a musical piece. Hereinafter will be described the processing of measure substitution referring to a flowchart of the subroutine for step SB10. To begin with, the rules used in the processing is explained with reference to FIG. 11. FIG. 11 is a table showing the relationship between the measures included in a phrase in the inputted composition conditions and the measures to be employed in the corresponding phrase of the above-modified musical template. This table shows the patterns of measure substitution for each of the numbers of measures included in one phrase in the inputted conditions.

The rules will be summarized as follows. When the number of measures within a phrase in the template is the same as the number of measures within a phrase in the inputted conditions, the respectively corresponding measures in the template are used for the output candidate. When the number of measures within a phrase in the template is more than the number of measures within a phrase in the inputted conditions, the measures in the template respectively corresponding to the measures in the inputted conditions except the last measure in the inputted conditions are used for the output candidate. For the last measure as requested by the inputted conditions, the last measure of the phrase in the template will be employed. But when the number of measures within a phrase in the template is less than the number of measures as required by the inputted composition conditions, no substitution process will take place and the template will no longer be processed for modification to make a candidate template as the work output of this measure substitution processing.

Specifically, in case the inputted conditions require that a phrase should have two measures, for example, there will be two patterns of measure employment as shown in the table of FIG. 11. They are:

(1) When the subject phrase in the template has two measures (@1 and @2), phrase @1 is determined for the first measure of the work output and phrase @2 is determined for the second measure of the work output.

(2) when the subject phrase in the template has three measures (@1, @2 and @3), phrase @1 is determined for the first measure of the work output and phrase @3 is determined for the second measure of the work output.

It should be understood here that for the simplicity's sake, the number of measures included in a phrase in the inputted conditions is limited to three in the present embodiment. Hereinbelow will be an explanation about the measure substitution processing performed in the embodiment of the present invention.

2-4(a). Common Processes

Figure 12:
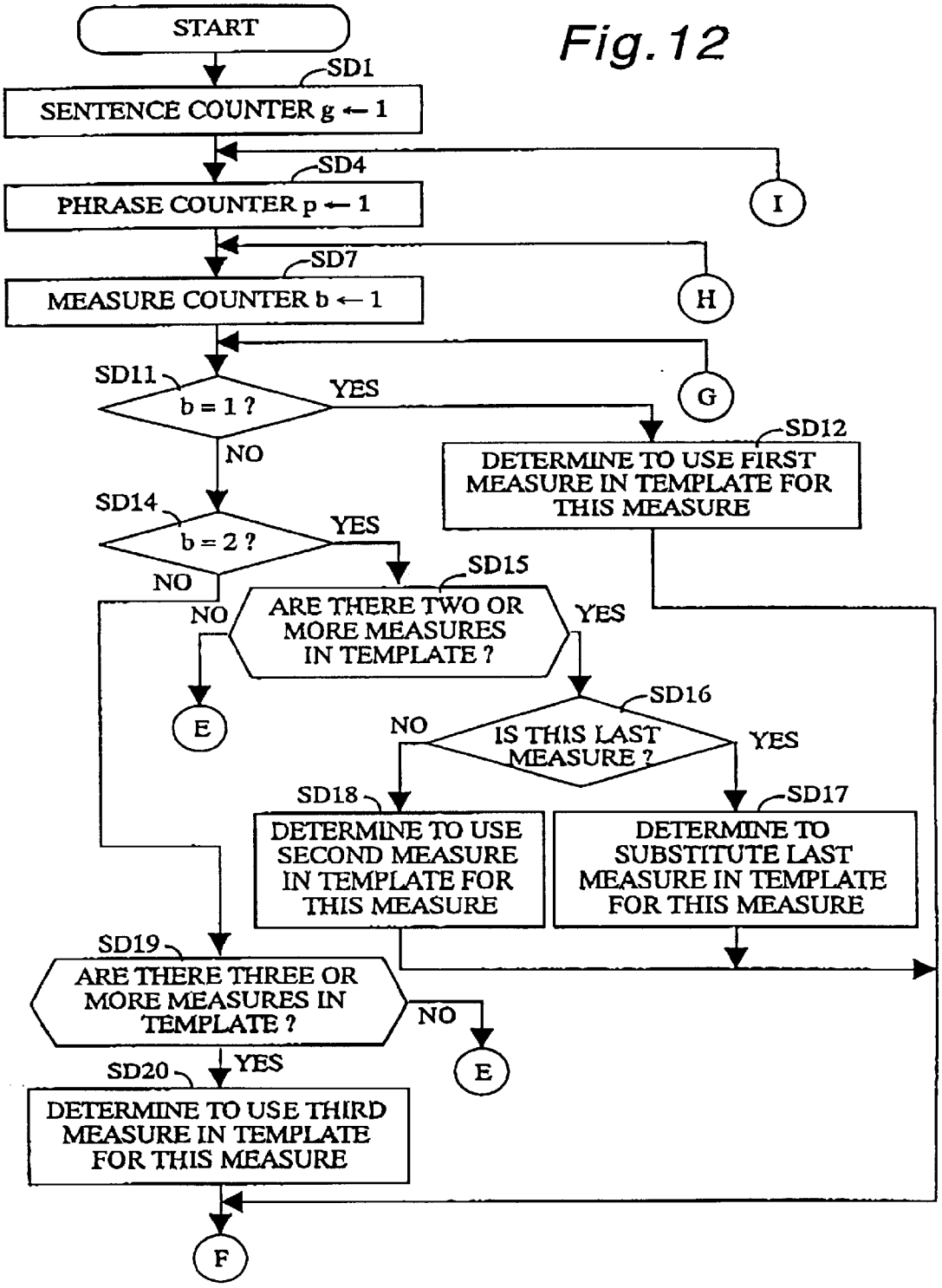
FIGS. 12 and 13 in combination is a flowchart showing a process flow for measure substitution processing in the present invention.
Figure 13:
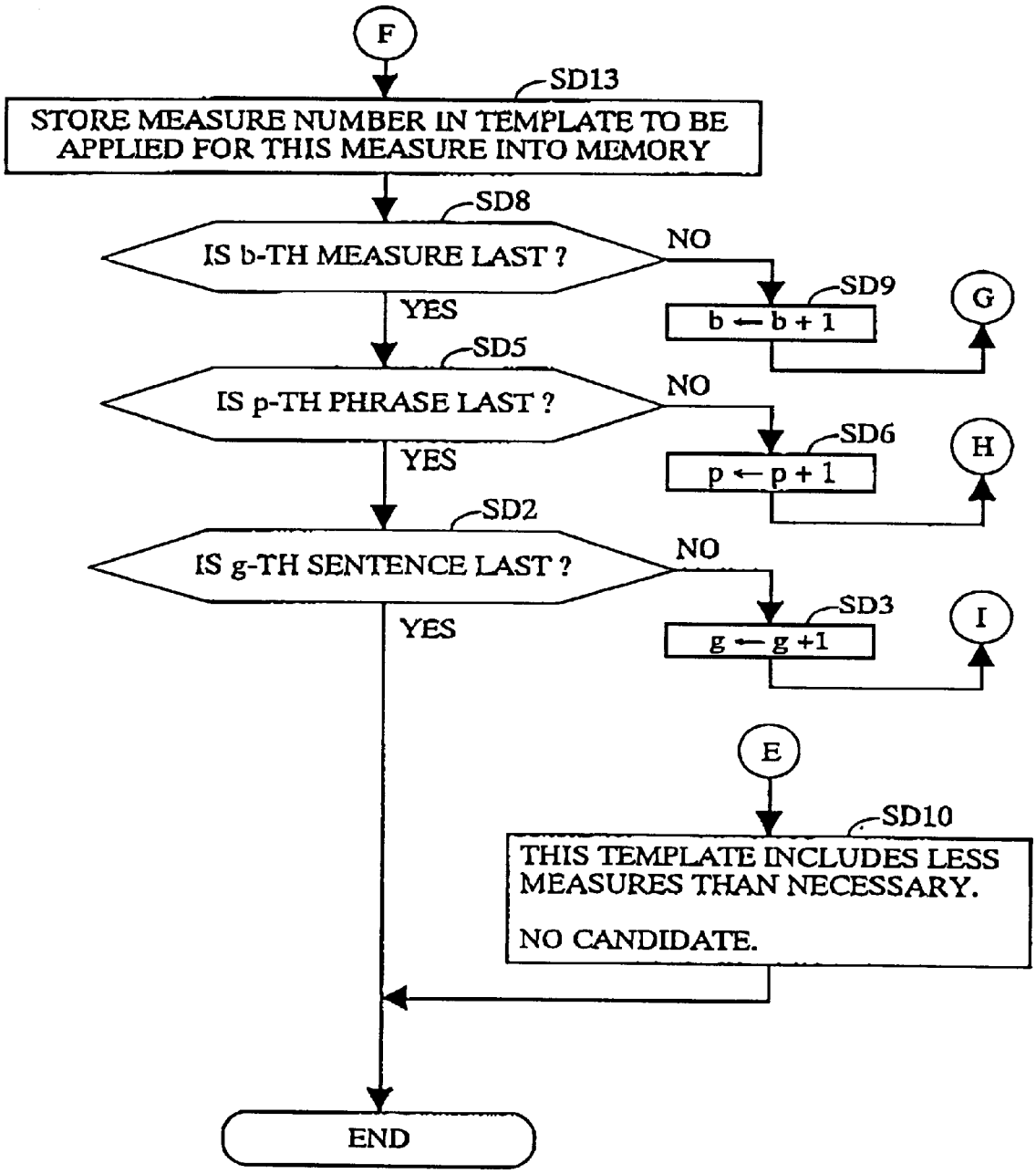

FIGS. 12 and 13 in combination show a flowchart showing a process flow for measure substitution processing in the present invention, each of the encircled points E, F, G, H and I being connected with the same letter point. As seen in these Figures, step SD1 initially puts a value "1" into the sentence counter "g" which is a variable identifying the subject sentence. From step SD4 onward, the measure substitution processing will be conducted for the measures one after another in each phrase in the subject sentence, with the sentence counter being incremented at steps SD2 and SD3 every time the measure substitution processing wilt respect to all the phrases has been completed for each subject sentence, until the measure substitution processing will have been performed for the last sentence.

Step SD4 is to put a value "1" into the phrase counter p which is a variable identifying the subject phrase. From step SD1 onward, the measure substitution processing will be conducted for the measures one after another included in each subject phrase, with the phrase counter being incremented through steps SD5 and SD6 every time the measure substitution processing has been completed for each subject phrase, until the measure substitution processing will have been performed for the last phrase of the subject sentence.

Step SD7 is to put a value "1" into the measure counter b which is a variable identifying the subject measure, and steps SD11 and onward perform measure substitution processing about each subject measure, incrementing the measure counter b at step SC9 every time the measure substitution processing has been completed for each subject measure, until the measure substitution processing will have been conducted for the last measure in the subject phrase (being judged at step SD8). When the comparison processing (for substitution) will have been finished for the last measure, the process moves forward to step SB11 in FIG. 6 to judge the substitutability (availability) of the template. When substitution has not been successful due to shortage in the number of measures, step SD10 directs the following step SB11 in FIG. 6 to move to step SB13.

2-4(b). Specific Processes

Figure 14:
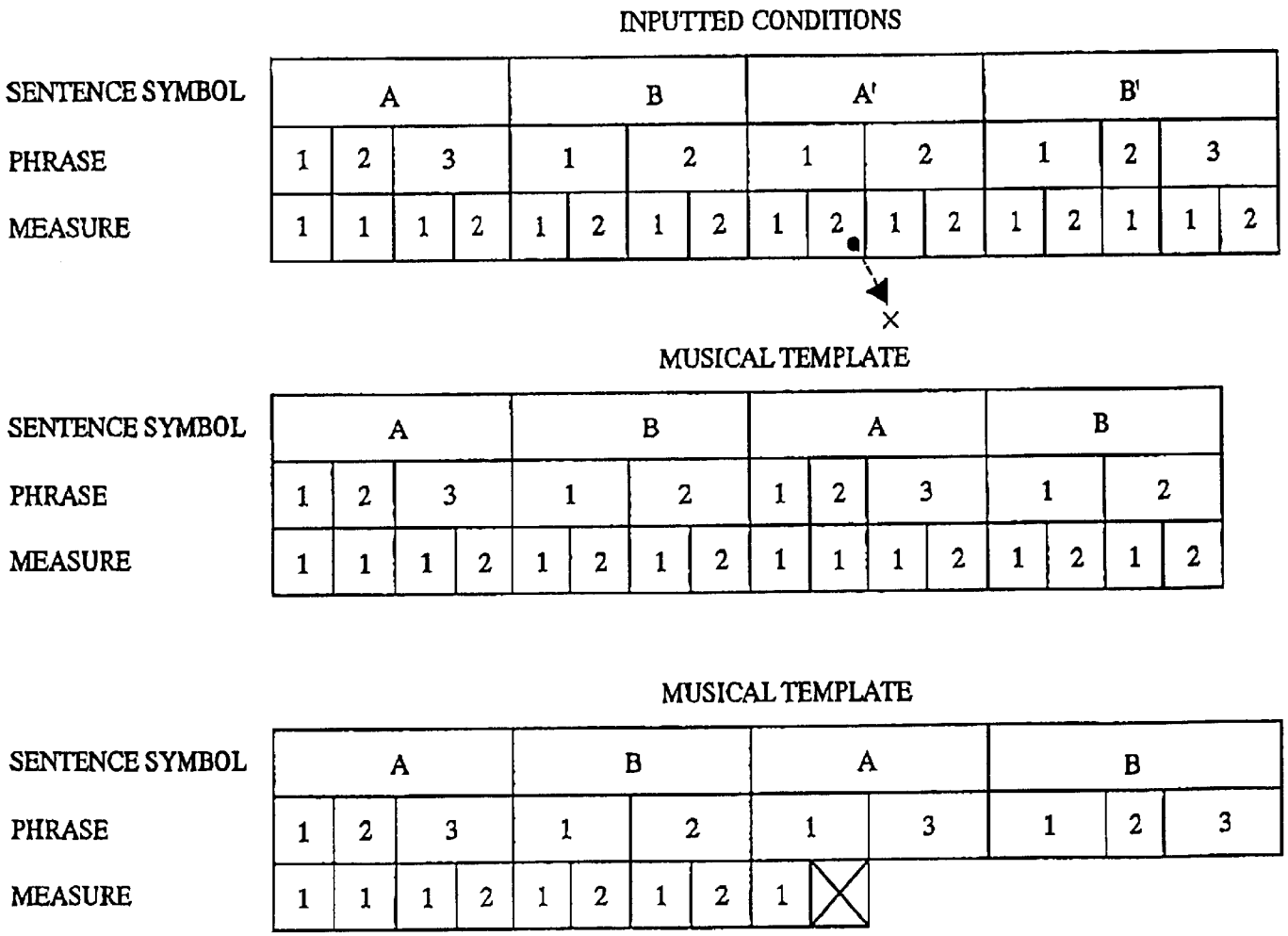
FIG. 14 is tables showing how the measure substitution processing will be conducted in the present invention.

The processing from step SD11 onward includes processes specific to the given cases. An explanation will be made on the examples shown in FIGS. 9, 10 and 14, in which each level of the hierarchical structure of the musical piece is aligned in the ascending order, e.g. the sentences are aligned in the order of first, second, third, and so forth, the phrases in a sentence are in the similar order, and likewise are the measures in a phrase.

(b-1): Case of FIG. 9

In this case, step SD11 judges whether the subject measure is the first measure or not. As the subject measure is the first measure at the beginning, step SD11 judges "YES" and accordingly step SD12 determines to use the first measure ((@1) of the first phrase of the first sentence in the musical template under examination for the subject measure in the work output. The measure number "1" is stored in the predetermined area of the RAM 2 at step SD13.

Next, for example, when the subject measure is the second measure of the second phrase in the second sentence, step SD11 judges "NO", step SD14 judges "YES", and step SD15 judges "YES". As the second measure is not the last measure in the second phrase of the second sentence, step SD16 Judges "NO" and the process flows to step SD18 to determine the use of the second measure of the second phrase of the second sentence in the subject template for the subject measure of the candidate to be outputted, and then the measure number "2" is stored in the predetermined area of the RAM 2 at step SD13.

As the subject measure is next shifted to the succeeding third measure, steps SD11 and SD14 both judge "NO" and the process moves to step SD19 to judge whether there are three or more measures in the second phrase of the second sentence in the subject template. As the answer of the judgment is "YES" , step SD20 determines to use the third measure of the second phrase of the second sentence in the subject template, and the measure number "3" is stored in the predetermined area of the RAM 2 at step SD13.

Further, for example, as to the second measure of the third phrase in the fourth sentence, step SD11 judges "NO" and then step SD14 judges "YES". Then the judgment whether tile number of measures included in the subject phrase of the template is two or more, and the judgment whether the second measure is the last measure in the subject phrase in the template will be made at steps SD15 and SD16, respectively. As the result of judgment at step SD16 is "YES", step SD17 determines to use (substitute) the last measure i.e. the third measure of the second phrase of the fourth sentence in the template for the second measure of the second phrase of the fourth sentence for a candidate output. Step SD13 then stores the measure number "3" in the predetermined area of the RAM 2.

(b-2): Case of FIG. 10

This case is different from the case of FIG. 9 greatly at the third measure of the third phrase in the fourth sentence. As to the process of this third measure, steps SD11 and SD14 judges "NO", and step SD19 also judges "NO", as there are less than three measures in the substituted third phrase of the fourth sentence in the modified template (at bottom table). After all, step SD10 determines not to make this template a candidate for a work output of this processing due to shortage in the number of measures.

(b-3): Case of FIG. 14

This case is different from the case of FIG. 9 greatly at the second measure of the first phrase in the third sentence. In the process flow with respect to this second measure, step SD11 judges "NO"and step SD14 judges "YES", but step SD15 judges "NO", as there are less than two measures in the first phrase of the third sentence. After all, step SD10 determines not to employ this template as a candidate to be used for composing a musical piece by the apparatus of the present invention.

2-5. Candidate Data Assembly

Figure 3:
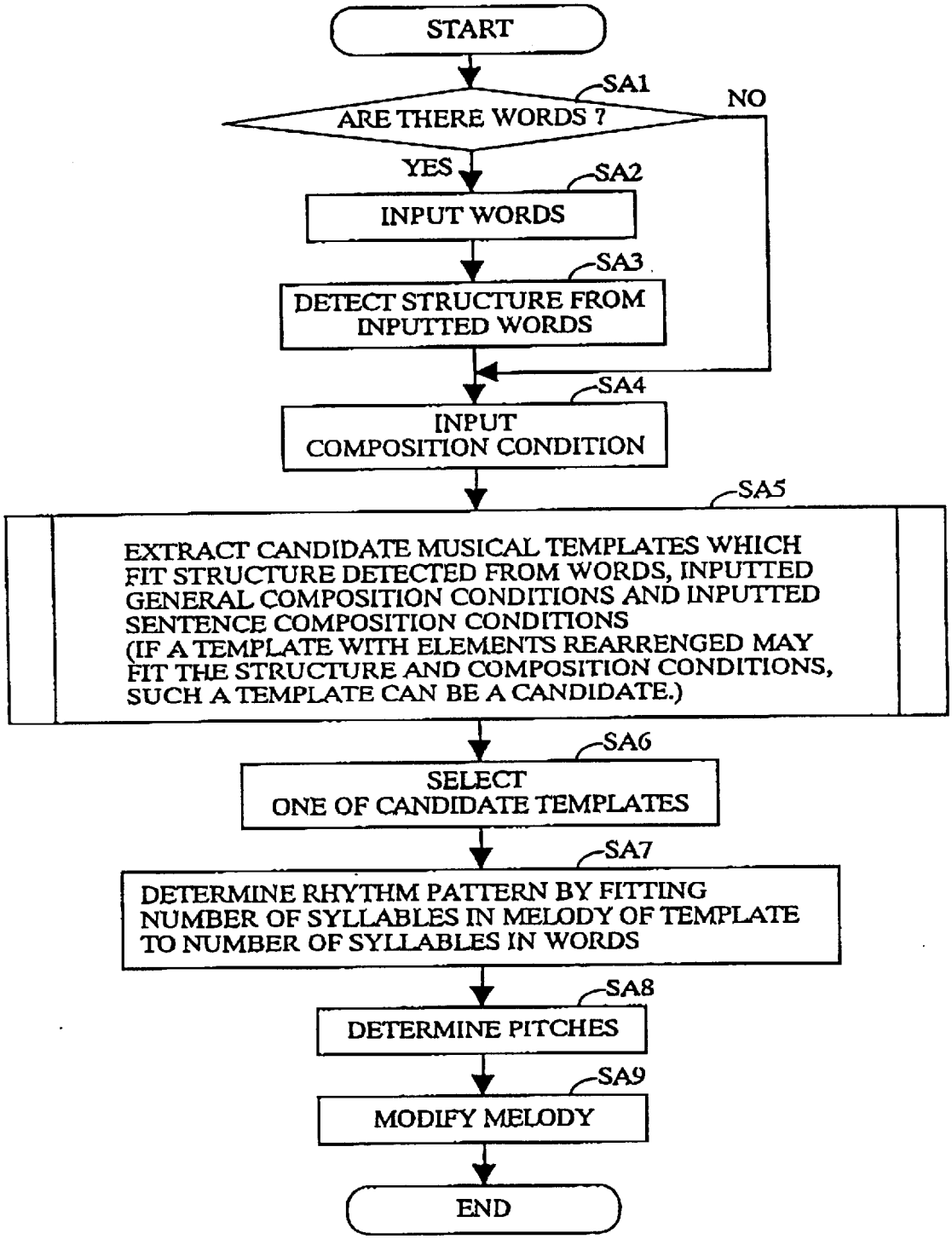
FIG. 3 is a flowchart showing the overall process flow of automatic music composition to generate a melody, including composition condition input processing and melody generation processing in the present invention.
Figure 4:
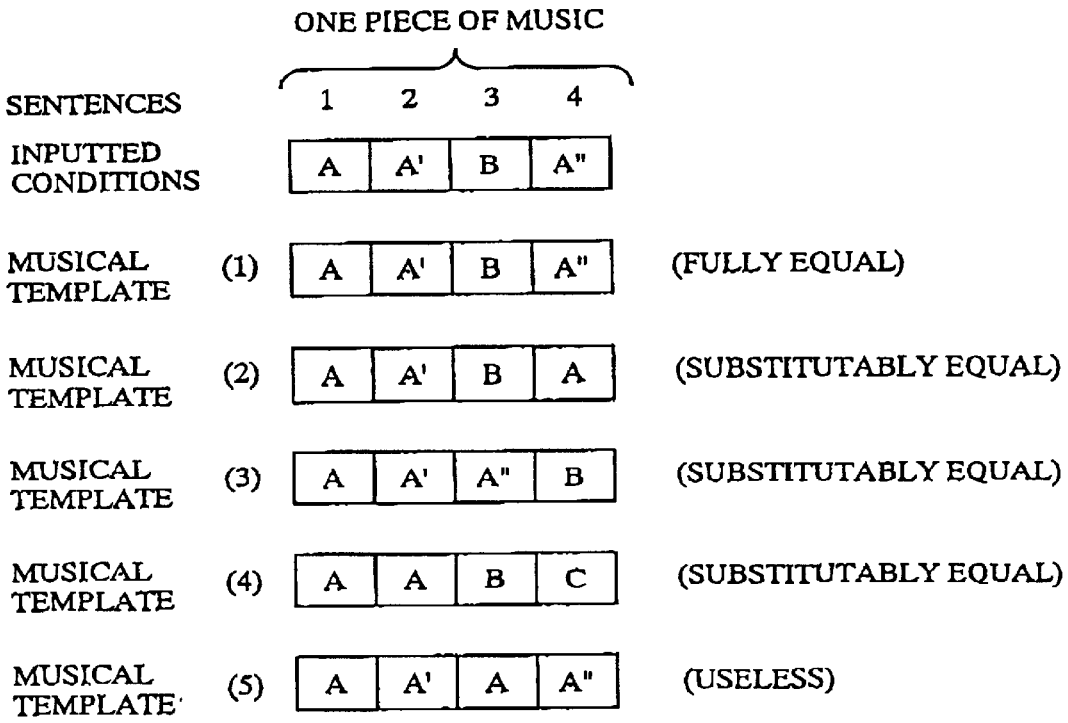
FIG. 4 is a chart showing how candidate templates will be extracted by comparison with the inputted composition conditions in the present invention.

According to the above described various processes, musical templates which is fully equal to or tolerably similar to the inputted composition conditions have been extracted as candidates for the further processing from step SA6 and onward in FIG. 3 to compose a musical piece according to the present invention FIG. 15 shows an example of the data assembly which have been obtained and stored in the predetermined area of the RAM 2 at the end of the processing of step SA5 in FIG. 3. As seen from FIG. 15, the data assembly constituting one musical template starts with the identifier number of the musical template and ends with the data-end mark "/" of the musical piece. After at least one repetition of a musical template, there is stored the all-data-end mark "END". The start of each sentence is denoted by the similarity symbol of the sentence, the start of each phrase is denoted by the phrase number, and each measure is denoted by the measure number. In the example of FIG. 15, there are three areas allotted for measures in each phrase, and the mark "-" is stored at non-use area for the measure. If no candidate template has been extracted, the above-allotted area in the RAM 2 includes only the all-data-end mark "END" stored therein.

3. Conclusion

As explained above, according to the described embodiment of the present invention, not only a musical template which is fully equal to the inputted composition conditions in terms of musical structure and musical feature but also a musical template which is tolerably similar (substitutably equal) to the composition conditions can be extracted as a candidate for the composition procedure in the automatic music composing apparatus of the present invention. By introducing substitution of sentences for establishing a candidate musical template after trial of modification by the order exchange (position exchange) and the multiple use of the sentences in the previously stored sample templates, more templates can be extracted as available candidates than in the conventional candidate extraction technology. Further, the similarity of the sentence is indicated by the use of letters with primes, different letters indicating major differences in the musical feature and different numbers (including zero) of primes indicating minor differences according to the number of primes, and further the order exchange and the multiple use of the sentences are performed taking the primes in the sentence symbols into consideration, and therefore the templates which are substitutably equal to or similar to the required conditions can be easily found during processing. Alternatively, the candidate templates may be determined without performing the order exchange or the multiple use.

As the phrase substitution processing of this invention includes the general rule of employing the last phrase of the subject sentence in the template for the last phrase of the subject sentence as required by the composition conditions, in case the template has more phrases in the subject sentence than the number of phrases in the corresponding sentence of the composition conditions, the last phrase of each sentence in the candidate composition shall be the actual last phrase of the sentence in the prepared template, and consequently the natural ending feeling incorporated in the prepared template can be maintained (be advantageously utilized), which can control or mitigate the possible incongruity resulted from the order exchange or the multiple use of the phrases.

4. Modifications

While the above description is about the example which is provided with templates, each for one piece of music, the unit for the template may be otherwise such as a template per sentence, per phrase and per some other unit. While the template of the embodiment include the rhythm pattern and the pitch pattern corresponding to each other, the two patterns may be separately provided, or alternatively only one of the patterns may well be prepared In the above described embodiment, the data retrieval key for searching the musical templates is the sentence similarity symbol, but the retrieval key need not be limited thereto but may be flexible such as using the number of syllables of the words for a song. Or, both keys can be used to determine available templates. In such a situation, elongated vowels may be given more than one beating (musically counted syllable) and may be given different note pitches as well.

Further in the above described embodiment the number of primes for the similarity symbol is limited to two, but may be more than two for embodying the present invention. Also in the above described embodiment, the number of sentences is four or less, the number of phrases is three or less and the number of measures is three or less both in the inputted composition conditions and in the musical templates, but those numbers may not be limited thereto.

Still further in the above described embodiment, the apparatus is realized as a system using a general purpose computer architecture, but the apparatus may be practiced in the form of an electronic musical instrument, in which the note playing keyboard and various control switches can serve as the above explained keyboard and pointing device. And further, an electronic musical instrument may not be limited to the type of a keyboard musical instrument, but may be the type (or form) of a stringed musical instrument, a wind musical instrument and a percussion musical instrument. The tone generator and the automatic performance device may be installed within an electronic musical instrument, and also may be provided externally and connected with the associated devices via MIDI cables and other networks. Needless to say, the invention may be applied to an automatic player piano.

In the above described embodiment, the application software is stored in a magnetic disk, an optical disk or a magneto-optical disk on a general purpose computer system and is read out therefrom to execute on the general purpose computer to perform the intended respective performances, but the storage medium may be any other type such as semiconductor memories. Further, an application software may be transmitted via a communication network, and may be downloaded through a communication interface before execution of the program.

In the case of downloading the application software from the communication network, the following architecture may be used as an example. The communication interface is connected to a communication network such as a LAN (local area network), the Internet and a public data or telephone network, via which is connected with a server computer. The automatic music composing apparatus, as a client in the network, will transmit commands requesting programs and data from the server computer via the communication interface and the communication network, when the storage medium equipped in the apparatus itself does not contain the necessary control programs and various data. Upon receipt of such commands, the server computer will deliver the requested programs and data to the automatic music composing apparatus via the communication network. The automatic music composing apparatus then receives the delivered programs and data through t he communication interface and stores in its storage medium thus completing downloading.

As will be understood by those skilled in the art this invention extracts as a candidate output not only the templates which are exactly the same as the composition conditions, but also the templates which are similar to the composition conditions, and therefore is advantageous in obtaining necessary candidate musical templates without degrading the composition conditions, even though there may not exist a template which perfectly meets the composition conditions. Namely, the apparatus extracts many candidate templates (as compared with the conventional apparatus) and thereby enhances the freedom in composition and secure versatility in melody. Further, by using the last phrase or the last measure in the template in correspondence to the last phrase or the last measure in the composition conditions in case the number of phrases or measures is different between the template and the conditions, the incongruity which may otherwise occur from the process of matching such numbers between the template and the conditions will be well controlled and mitigated in the present invention.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An automatic music composing apparatus comprising:

a template data base storing a plurality of musical templates each including a set of data defining a musical piece, said musical piece being subdivided into a plurality of musical segments, said set of data including subsets of data respectively defining musical properties of said musical segments;

input means for inputting composition conditions including requirements on musical properties for a musical piece to be composed;

retrieval means for searching said template data base to extract at least one candidate musical template which includes said subset of data indicative of the musical properties which are identical with or similar to the musical properties required by the inputted composition conditions; and composition means for composing a musical piece based on one of said at least one extracted candidate musical template.

2. An automatic music composing apparatus as claimed in claim 1, in which said musical segments constitute musical sentences;

said subsets of data include data which define sentence symbols indicative of degrees of similarity among the musical sentences in terms of the musical properties;

said composition conditions include musical sentence symbols covering a series of plural musical sentences in a musical piece and being indicative of degrees of similarity among the musical sentences in terms of the musical properties; and said retrieval means includes substitution means which, when said sentence symbols included in said musical template are not identical with the sentence symbols included in said inputted composition conditions comparing sentence by sentence, extracts a musical template having the sentence symbols which are substitutable for the sentence symbols in said inputted composition conditions according to a predetermined rule.

3. An automatic music composing apparatus as claimed in claim 2, in which said predetermined rule is that a sentence symbol in the musical template is substitutable for the corresponding sentence symbol in the composition conditions, when said sentence symbol in the musical template is similar to said corresponding sentence symbol in the composition conditions.

4. An automatic music composing apparatus as claimed in claim 2, in which said substitution means includes means to substitute another sentence within the musical template for the sentence in the same musical template in comparison with the corresponding sentence in the composition conditions, and said predetermined rule is that a sentence symbol in the musical template is substitutable for the corresponding sentence symbol in the composition conditions, when said sentence symbol in the musical template is identical to or similar to said corresponding sentence symbol in the composition conditions, after the substitution of the sentence in the musical template.

5. An automatic music composing apparatus as claimed in claim 4, in which said substitution means includes means to exchange the aligned position of the sentences in the musical template.

6. An automatic music composing apparatus as claimed in claim 1, in which said musical segments constitute musical phrases;

said subsets of data include data indicative of the number of phrases;

said composition conditions include the number of phrases; and said retrieval means includes means which, when said number of phrases in the template is not equal to said number of phrases in the composition conditions, extracts a musical template after modifying the template under comparison with the composition conditions to have the same number of phrases as the composition conditions.

7. An automatic music composing apparatus as claimed in claim 6, in which said retrieval means include means which, when there are a plurality of phrases both in the musical template and the composition conditions, uses the last phrase in the template for the phrase position in the template corresponding to the last phrase in the composition conditions.

8. An automatic music composing apparatus as claimed in claim 1, in which said musical segments constitute musical measures;

said subsets of data include data indicative of the number of measures;

said composition conditions include the number of measures; and said retrieval means includes means which, when said number of measures in the template is greater than said number of measures in the composition conditions, extracts a musical template after modifying the template under comparison with the composition conditions to have the same number of measures as the composition conditions, but when said number of measures in the template is less than said number of measures in the composition conditions, does not extract the template as a candidate.

9. An automatic music composing apparatus as claimed in claim 8, in which said retrieval means include means which, when there are more measures in the musical template than in the composition conditions, uses the last measure in the template for the measure position in the template corresponding to the last measure in the composition conditions, but when there are less measures in the musical template than in the composition conditions, said retrieval means does not extract the template as a candidate.

10. An automatic music composing apparatus comprising:

a word input means for inputting words for a musical piece to he composed;

construction information extracting means for extracting information representing a construction for said musical piece from said inputted words;

a template data base storing a plurality of musical templates each including a set of data defining a musical piece, said set of data including data representing the musical construction of said musical piece;

retrieval means for searching said template data base to extract at least one candidate musical template which includes said data indicative of the construction of said musical piece which is identical with or similar to the construction represented by said extracted information; and composition means for composing a musical piece which meets said inputted words based on one of said at least one extracted candidate musical template.

11. An automatic music composing apparatus as claimed in claim 10 further comprising:

input means for inputting composition conditions including requirements on musical properties for a musical piece to be composed; and in which said retrieval means extract at least one candidate musical template which includes said data indicative of the construction of said musical piece which is identical with or similar to the construction represented by either of or both of said composition conditions and said information representing a construction for said musical piece from said inputted words.

12. A computer readable medium on which is stored a computer program for composing a musical piece, said computer program comprising program instructions which, when read and executed by a computer system, configure the computer system to perform the steps of:

providing a template data base including a plurality of musical templates each including a set of data defining a musical piece, said musical piece being subdivided into a plurality of musical segments, said set of data including subsets of data respectively defining musical properties of said musical segments;

inputting composition conditions including requirements on musical properties for a musical piece to be composed;

searching said template data base to extract at least one candidate musical template which includes said subset of data indicative of the musical properties which are identical with or similar to the musical properties required by the inputted composition conditions; and composing a musical piece based on one of said at least one extracted candidate musical template.

13. A computer readable medium on which is stored a computer program for composing a musical piece, said computer program comprising program instructions which, when read and executed by a computer system, configure the computer system to perform the steps of:

inputting words for a musical piece to be composed;

extracting information representing a construction for said musical piece from the inputted words;

providing a template data base including a plurality of musical templates each including a set of data defining a musical piece, said set of data including data representing the musical construction of said musical piece;

searching said template data base to extract at least one candidate musical template which includes said data indicative of the construction of said musical piece which is identical with or similar to the construction represented by said extracted information; and composing a musical piece which meets said inputted words based on one of said at least one extracted candidate musical template.

14. A method for composing a musical piece comprising the steps of:

providing a template data base including a plurality of musical templates each including a set of data defining a musical piece, said musical piece being subdivided into a plurality of musical segments, said set of data including subsets of data respectively defining musical properties of said musical segments;

inputting composition conditions including requirements on musical properties for a musical piece to be composed;

searching said template data base to extract at least one candidate musical template which includes said subset of data indicative of the musical properties which are identical with or similar to the musical properties required by the inputted composition conditions; and composing a musical piece based on one of said at least one extracted candidate musical template.

15. A method for composing a musical piece comprising the steps of:

inputting words for a musical piece to be composed;

extracting information representing a construction for said musical piece from the inputted words;

providing a template data base including a plurality of musical templates each including a set of data defining a musical piece, said set of data including data representing the musical construction of said musical piece;

searching said template data base to extract at least one candidate musical template which includes said data indicative of the construction of said musical piece which is identical with or similar to the construction represented by said extracted information; and composing a musical piece which meets said inputted words based on one of said at least one extracted candidate musical template.

16. An automatic music composing apparatus comprising:

a template data base storing a plurality of musical templates each including a set of data defining a musical piece, said musical piece being subdivided into a plurality of musical segments, said set of data including subsets of data respectively defining musical properties of said musical segments;

an input device which receives inputs of composition conditions including requirements on musical properties for a musical piece to be composed;

a retrieval device which searches said template data base to extract at least one candidate musical template which includes said subset of data indicative of the musical properties which are identical with or similar to the musical properties required by the inputted composition conditions; and a composing device which composes a musical piece based on one of said at least one extracted candidate musical template.

17. An automatic music composing apparatus comprising:

a word input device which receives inputs of words for a musical piece to be composed;

construction information extracting device which extracts information representing a construction for said musical piece from said words;

a template data base storing a plurality of musical templates each including a set of data defining a musical piece, said set of data including data representing the musical construction of said musical piece;

a retrieval device which searches said template data base to extract at least one candidate musical template which includes said data indicative of the construction of said musical piece which is identical with or similar to the construction represented by said extracted information; and a composition device which composes a musical piece which meets said words based on one of said at least one extracted candidate musical template.

* * * * *